US011813712B2

(12) United States Patent
Khanna et al.

(10) Patent No.: US 11,813,712 B2
(45) Date of Patent: Nov. 14, 2023

(54) POLISHING PADS HAVING SELECTIVELY ARRANGED POROSITY

(71) Applicant: Applied Materials, Inc., Santa Clara, CA (US)

(72) Inventors: Aniruddh Jagdish Khanna, Fremont, CA (US); Jason G. Fung, Santa Clara, CA (US); Puneet Narendra Jawali, San Jose, CA (US); Rajeev Bajaj, Fremont, CA (US); Adam Wade Manzonie, Santa Clara, CA (US); Nandan Baradanahalli Kenchappa, San Jose, CA (US); Veera Raghava Reddy Kakireddy, Santa Clara, CA (US); Joonho An, Pyeongtaek (KR); Jaeseok Kim, Cupertino, CA (US); Mayu Yamamura, San Mateo, CA (US)

(73) Assignee: Applied Materials, Inc., Santa Clara, CA (US)

( * ) Notice: Subject to any disclaimer, the term of this patent is extended or adjusted under 35 U.S.C. 154(b) by 269 days.

(21) Appl. No.: 17/036,623

(22) Filed: Sep. 29, 2020

(65) Prior Publication Data

US 2021/0187693 A1 Jun. 24, 2021

Related U.S. Application Data

(60) Provisional application No. 62/951,938, filed on Dec. 20, 2019.

(51) Int. Cl.

| | |
|---|---|
| ***B24B 37/02*** | (2012.01) |
| ***B24B 37/04*** | (2012.01) |
| ***B24B 37/20*** | (2012.01) |

(52) U.S. Cl.
CPC ..... *B24B 37/20* (2013.01); *B24B 37/042* (2013.01)

(58) Field of Classification Search
CPC ..... B24B 37/20; B24B 37/22; B24B 37/24; B24B 37/26
See application file for complete search history.

(56) References Cited

U.S. PATENT DOCUMENTS

| | | | |
|---|---|---|---|
| 2,001,911 | A | 5/1935 | Wooddell et al. |
| 3,357,598 | A | 12/1967 | Kraft |

(Continued)

FOREIGN PATENT DOCUMENTS

| | | | |
|---|---|---|---|
| CN | 1897226 | A | 1/2007 |
| CN | 101199994 | A | 6/2008 |

(Continued)

OTHER PUBLICATIONS

International Search Report and Written Opinion of the International Searching Authority for PCT/US2020/061656 dated Mar. 15, 2021, 11 pages.

(Continued)

*Primary Examiner* — Don M Anderson
*Assistant Examiner* — Jonathan R Zaworski
(74) *Attorney, Agent, or Firm* — Patterson + Sheridan, LLP

(57) ABSTRACT

Polishing pads having discrete and selectively arranged regions of varying porosity within a continuous phase of polymer material are provided herein. In one embodiment a polishing pad features a plurality of polishing elements each comprising a polishing surface and sidewalls extending downwardly from the polishing surface to define a plurality of channels disposed between the polishing elements, wherein one or more of the polishing elements is formed of a continuous phase of polymer material having one or more (Continued)

first regions comprising a first porosity and a second region comprising a second porosity, wherein the second porosity is less than the first porosity.

20 Claims, 9 Drawing Sheets

(56) References Cited

U.S. PATENT DOCUMENTS 3,741,116 A 6/1973 Green et al.
4,459,779 A 7/1984 Shen
4,575,330 A 3/1986 Hull
4,836,832 A 6/1989 Tumey et al.
4,844,144 A 7/1989 Murphy et al.
4,942,001 A 7/1990 Murphy et al.
5,096,530 A 3/1992 Cohen
5,120,476 A 6/1992 Scholz
5,121,329 A 6/1992 Crump
5,178,646 A 1/1993 Barber, Jr. et al.
5,212,910 A 5/1993 Breivogel et al.
5,287,663 A 2/1994 Pierce et al.
5,300,417 A 4/1994 Lushington et al.
5,387,380 A 2/1995 Cima et al.
5,533,923 A 7/1996 Shamouilian et al.
5,605,760 A 2/1997 Roberts
5,609,517 A 3/1997 Lofaro
5,624,303 A 4/1997 Robinson
5,626,919 A 5/1997 Chapman et al.
5,645,471 A 7/1997 Strecker
5,738,574 A 4/1998 Tolles et al.
5,876,268 A 3/1999 Lamphere et al.
5,900,164 A 5/1999 Budinger et al.
5,905,099 A 5/1999 Everaerts et al.
5,906,863 A 5/1999 Lombardi et al.
5,921,855 A 7/1999 Osterheld et al.
5,932,040 A 8/1999 Audisio
5,932,290 A 8/1999 Lombardi et al.
5,940,674 A 8/1999 Sachs et al.
5,944,583 A 8/1999 Cruz et al.
5,965,460 A 10/1999 Rach et al.
5,976,000 A 11/1999 Hudson
5,984,769 A 11/1999 Bennett et al.
5,989,111 A 11/1999 Lamphere et al.
5,989,470 A 11/1999 Doan et al.
6,022,264 A 2/2000 Cook et al.
6,029,096 A 2/2000 Manners et al.
6,036,579 A 3/2000 Cook et al.
6,062,968 A 5/2000 Sevilla et al.
6,090,475 A 7/2000 Robinson et al.
6,095,902 A 8/2000 Reinhardt
6,117,000 A 9/2000 Anjur et al.
6,121,143 A 9/2000 Messner et al.
6,122,564 A 9/2000 Koch et al.
6,126,532 A 10/2000 Sevilla et al.
6,155,910 A 12/2000 Amphere et al.
6,206,759 B1 3/2001 Agarwal et al.
6,210,254 B1 4/2001 Cook et al.
6,213,845 B1 4/2001 Elledge
6,231,942 B1 5/2001 Blizard et al.
6,241,596 B1 6/2001 Osterheld et al.
6,254,460 B1 7/2001 Walker et al.
6,273,806 B1 8/2001 Bennett et al.
6,322,728 B1 11/2001 Brodkin et al.
6,328,634 B1 12/2001 Shen et al.
6,361,411 B1 3/2002 Chopra et al.
6,361,832 B1 3/2002 Agarwal et al.
6,390,890 B1 5/2002 Molnar
6,423,255 B1 7/2002 Hoechsmann et al.
6,428,586 B1 8/2002 Yancey
6,454,634 B1 9/2002 James et al.
6,488,570 B1 12/2002 James et al.
6,500,053 B2 12/2002 James et al.
6,518,162 B2 2/2003 Ono et al.
6,520,834 B1 2/2003 Marshall
6,520,847 B2 2/2003 Osterheld et al.
6,530,829 B1 * 3/2003 Kramer ..... B24B 37/26 451/526
6,544,373 B2 4/2003 Chen et al.
6,569,373 B2 5/2003 Napadensky
6,582,283 B2 6/2003 James et al.
6,585,563 B1 7/2003 Redeker et al.
6,592,443 B1 7/2003 Kramer et al.
6,641,463 B1 11/2003 Molnar
6,641,471 B1 11/2003 Pinheiro et al.
6,645,061 B1 11/2003 Bennett et al.
6,682,402 B1 1/2004 Roberts et al.
6,699,115 B2 3/2004 Osterheld et al.
6,719,818 B1 4/2004 Birang et al.
6,736,709 B1 5/2004 James et al.
6,746,225 B1 6/2004 McHugh
6,749,485 B1 6/2004 James et al.
6,749,714 B1 6/2004 Ishikawa et al.
6,790,883 B2 9/2004 Ogawa et al.
6,796,880 B2 9/2004 Redeker et al.
6,811,937 B2 11/2004 Lawton
6,833,046 B2 12/2004 Wright
6,840,843 B2 1/2005 Jones et al.
6,855,588 B1 2/2005 Liao et al.
6,860,793 B2 3/2005 Budinger et al.
6,860,802 B1 3/2005 Vishwanathan et al.
6,869,350 B2 3/2005 Roberts et al.
6,875,096 B2 4/2005 Park et al.
6,875,097 B2 4/2005 Grunwald
6,896,593 B2 5/2005 Prasad
6,913,517 B2 7/2005 Prasad
6,935,931 B2 8/2005 Prasad
6,955,588 B1 10/2005 Anderson, II et al.
6,984,163 B2 1/2006 Roberts
6,991,517 B2 1/2006 Redeker et al.
6,998,166 B2 2/2006 Prasad
7,077,879 B2 7/2006 Ogawa et al.
7,120,512 B2 10/2006 Kramer et al.
7,132,033 B2 11/2006 Boldizar et al.
7,169,030 B1 1/2007 Kulp
7,195,544 B2 3/2007 Prasad
7,252,871 B2 8/2007 Crkvenac et al.
7,264,641 B2 9/2007 Prasad
7,267,607 B2 9/2007 Prasad
7,300,619 B2 11/2007 Napadensky et al.
7,311,862 B2 12/2007 Prasad
7,371,160 B1 5/2008 Cruz et al.
7,377,840 B2 5/2008 Deopura et al.
7,425,172 B2 9/2008 Misra et al.
7,435,161 B2 10/2008 Prasad et al.
7,435,165 B2 10/2008 Prasad
7,438,636 B2 10/2008 Kulp et al.
7,445,847 B2 11/2008 Kulp
7,455,571 B1 11/2008 Kuo et al.
7,497,885 B2 3/2009 Kollodge
7,517,277 B2 4/2009 Muldowney
7,517,488 B2 4/2009 Saikin
7,530,880 B2 5/2009 Bajaj et al.
7,531,117 B2 5/2009 Ederer et al.
7,537,446 B2 5/2009 James et al.
7,635,290 B2 12/2009 Muldowney
7,699,684 B2 4/2010 Prasad
7,704,122 B2 4/2010 Misra et al.
7,704,125 B2 4/2010 Roy et al.
7,815,778 B2 10/2010 Bajaj
7,828,634 B2 11/2010 Jiang et al.
7,846,008 B2 12/2010 Bajaj
7,976,901 B2 7/2011 Kume et al.
8,066,555 B2 11/2011 Bajaj
8,075,372 B2 * 12/2011 Prasad ..... B24B 37/26 451/529
8,075,745 B2 12/2011 Bajaj
8,118,641 B2 2/2012 Kulp et al.
8,142,860 B2 3/2012 Vanmaele et al.
8,142,869 B2 3/2012 Kobayashi et al.
8,177,603 B2 5/2012 Bajaj
8,257,545 B2 9/2012 Loyack et al.
8,260,447 B2 9/2012 Mattes et al.
8,287,793 B2 10/2012 Deopura et al.
8,288,448 B2 10/2012 Kulp

(56) References Cited

U.S. PATENT DOCUMENTS 8,292,692 B2 10/2012 Bajaj
8,377,623 B2 2/2013 Fong
8,380,339 B2 2/2013 Misra et al.
8,398,466 B2 3/2013 Sung et al.
8,546,717 B2 10/2013 Stecker
8,598,523 B2 12/2013 Stecker et al.
8,602,851 B2 12/2013 Lombardo et al.
8,702,479 B2 4/2014 Huang et al.
8,709,114 B2 4/2014 Cantrell et al.
8,715,035 B2 5/2014 Roy et al.
8,784,721 B2 7/2014 Philippi et al.
8,801,949 B2 8/2014 Lakrout et al.
8,821,214 B2 9/2014 Joseph
8,864,859 B2 10/2014 Roy et al.
8,883,392 B2 11/2014 Napadensky et al.
8,888,480 B2 11/2014 Yoo et al.
8,894,799 B2 11/2014 Lakrout
8,932,116 B2 1/2015 Deopura et al.
8,932,511 B2 1/2015 Napadensky
8,986,585 B2 3/2015 Cantrell et al.
9,017,140 B2 4/2015 Allison et al.
9,067,297 B2 6/2015 Allison et al.
9,067,299 B2 6/2015 Bajaj et al.
9,108,291 B2 8/2015 Lakrout
9,156,124 B2 10/2015 Allison et al.
9,162,340 B2 10/2015 Joseph et al.
9,162,341 B2 10/2015 LeFevre et al.
9,259,820 B2 2/2016 Qian et al.
9,259,821 B2 2/2016 Qian et al.
9,278,424 B2 3/2016 Roy et al.
9,296,085 B2 3/2016 Bajaj et al.
9,314,897 B2 4/2016 Qian et al.
9,333,620 B2 5/2016 Qian et al.
9,421,666 B2 8/2016 Krishnan et al.
9,457,520 B2 10/2016 Bajaj et al.
9,587,127 B2 3/2017 Herlihy et al.
9,630,249 B2 4/2017 Toyserkani et al.
9,744,724 B2 8/2017 Bajaj et al.
9,776,361 B2 10/2017 Krishnan et al.
9,873,180 B2 1/2018 Bajaj et al.
9,925,637 B2 * 3/2018 Yoshida ..... B24B 37/24
9,993,907 B2 6/2018 Murugesh et al.
10,335,994 B2 7/2019 Napadensky et al.
10,456,886 B2 10/2019 Ganapathiappan et al.
2001/0008830 A1 7/2001 Tolles et al.
2001/0020448 A1 9/2001 Vaartstra et al.
2001/0041511 A1 11/2001 Lack et al.
2001/0046834 A1 11/2001 Ramana et al.
2002/0016139 A1 2/2002 Hirokawa et al.
2002/0058468 A1 5/2002 Eppert et al.
2002/0077036 A1 6/2002 Roberts et al.
2002/0112632 A1 8/2002 Faibish
2002/0173248 A1 11/2002 Doan et al.
2003/0019570 A1 1/2003 Chen et al.
2003/0022611 A1 1/2003 Bartlett et al.
2003/0056870 A1 3/2003 Comb et al.
2003/0134581 A1 7/2003 Wang et al.
2003/0153253 A1 8/2003 Hanamoto et al.
2003/0181137 A1 9/2003 Redeker et al.
2003/0205325 A1 11/2003 Boyd et al.
2003/0220061 A1 11/2003 Prasad
2004/0003895 A1 1/2004 Amano et al.
2004/0033758 A1 2/2004 Wiswesser
2004/0055223 A1 3/2004 Ono et al.
2004/0058623 A1 3/2004 Lin et al.
2004/0106367 A1 6/2004 Walker et al.
2004/0126575 A1 7/2004 Yoshida et al.
2004/0133298 A1 7/2004 Toyserkani et al.
2004/0154533 A1 8/2004 Agarwal et al.
2004/0173946 A1 9/2004 Pfeifer et al.
2004/0175451 A1 9/2004 Maekawa et al.
2004/0180611 A1 9/2004 Tajima et al.
2004/0187714 A1 9/2004 Napadensky et al.
2004/0198185 A1 10/2004 Redeker et al.
2005/0003189 A1 1/2005 Bredt et al.
2005/0020082 A1 1/2005 Vishwanathan et al.
2005/0062900 A1 3/2005 Kim
2005/0086869 A1 4/2005 Park et al.
2005/0098540 A1 5/2005 Prasad
2005/0101228 A1 5/2005 Prasad
2005/0110853 A1 5/2005 Gardner et al.
2005/0153634 A1 7/2005 Prasad et al.
2005/0171224 A1 8/2005 Kulp
2005/0215177 A1 9/2005 Prasad
2005/0227590 A1 10/2005 Sung
2005/0250431 A1 11/2005 Shih et al.
2005/0284536 A1 12/2005 Kojima et al.
2006/0019587 A1 1/2006 Deopura et al.
2006/0052040 A1 3/2006 Prasad
2006/0125133 A1 6/2006 Huh et al.
2006/0160478 A1 7/2006 Donohue et al.
2006/0185256 A1 8/2006 Nevoret et al.
2006/0192315 A1 8/2006 Farr et al.
2006/0226567 A1 10/2006 James et al.
2006/0252900 A1 11/2006 Bowman et al.
2006/0276109 A1 12/2006 Roy et al.
2007/0007698 A1 1/2007 Sano
2007/0009606 A1 1/2007 Serdy et al.
2007/0054599 A1 3/2007 Taylor et al.
2007/0117393 A1 5/2007 Tregub et al.
2007/0128874 A1 6/2007 Shida et al.
2007/0128991 A1 6/2007 Yoon et al.
2007/0149096 A1 6/2007 Nishimura et al.
2007/0212979 A1 9/2007 Preston
2007/0221287 A1 9/2007 Izumoto
2007/0235133 A1 10/2007 Benassi
2007/0235904 A1 10/2007 Saikin
2008/0009228 A1 1/2008 Nagase et al.
2008/0057845 A1 3/2008 Prasad
2008/0105818 A1 5/2008 Cohen
2008/0157436 A1 7/2008 Patel et al.
2008/0207100 A1 8/2008 Roy et al.
2008/0211141 A1 9/2008 Deopura et al.
2008/0255823 A1 10/2008 Grant
2008/0314878 A1 12/2008 Cai et al.
2009/0011679 A1 1/2009 Bajaj et al.
2009/0053976 A1 2/2009 Roy et al.
2009/0093201 A1 4/2009 Kazuno et al.
2009/0105363 A1 4/2009 Napadensky
2009/0206065 A1 8/2009 Kruth et al.
2009/0253353 A1 10/2009 Ogawa et al.
2009/0270019 A1 10/2009 Bajaj
2009/0311955 A1 12/2009 Kerprich et al.
2009/0321979 A1 12/2009 Hiraide
2010/0007692 A1 1/2010 Vanmaele et al.
2010/0087128 A1 4/2010 Nakayama et al.
2010/0120249 A1 5/2010 Hirose et al.
2010/0120343 A1 5/2010 Kato et al.
2010/0140850 A1 6/2010 Napadensky et al.
2010/0203815 A1 8/2010 Bajaj
2010/0210197 A1 8/2010 Matsumura et al.
2010/0323050 A1 12/2010 Kumagai et al.
2011/0011217 A1 1/2011 Kojima
2011/0059247 A1 3/2011 Kuzusako et al.
2011/0077321 A1 3/2011 Napadensky
2011/0130077 A1 6/2011 Litke et al.
2011/0171890 A1 7/2011 Nakayama et al.
2011/0180952 A1 7/2011 Napadensky
2011/0183583 A1 7/2011 Joseph
2012/0178845 A1 7/2012 Napadensky et al.
2012/0302148 A1 11/2012 Bajaj et al.
2012/0315830 A1 12/2012 Joseph et al.
2013/0012108 A1 1/2013 Li et al.
2013/0017769 A1 1/2013 Kimura
2013/0019570 A1 1/2013 Weible
2013/0055568 A1 3/2013 Dusel et al.
2013/0059506 A1 3/2013 Qian et al.
2013/0059509 A1 3/2013 Deopura et al.
2013/0122705 A1 5/2013 Babu et al.
2013/0137350 A1 5/2013 Allison et al.
2013/0172509 A1 7/2013 Pawloski et al.
2013/0183824 A1 7/2013 Kwon et al.
2013/0212951 A1 8/2013 Ahn et al.
2013/0231032 A1 9/2013 Swedek et al.

(56) References Cited

U.S. PATENT DOCUMENTS

| | | | |
|---|---|---|---|
| 2013/0283700 | A1 | 10/2013 | Bajaj et al. |
| 2013/0307194 | A1 | 11/2013 | Elsey |
| 2013/0309951 | A1 | 11/2013 | Benvegnu et al. |
| 2013/0316081 | A1 | 11/2013 | Kovalcik et al. |
| 2013/0328228 | A1 | 12/2013 | Pettis et al. |
| 2014/0048970 | A1 | 2/2014 | Batchelder et al. |
| 2014/0117575 | A1 | 5/2014 | Kemperle et al. |
| 2014/0163717 | A1 | 6/2014 | Das et al. |
| 2014/0206268 | A1 | 7/2014 | Lefevre et al. |
| 2014/0239527 | A1 | 8/2014 | Lee |
| 2014/0324206 | A1 | 10/2014 | Napadensky |
| 2014/0370214 | A1 | 12/2014 | Araki et al. |
| 2014/0370788 | A1 | 12/2014 | Nair |
| 2015/0024233 | A1 | 1/2015 | Gunther |
| 2015/0031781 | A1 | 1/2015 | Landers et al. |
| 2015/0037601 | A1 | 2/2015 | Blackmore |
| 2015/0038066 | A1 | 2/2015 | Tuang et al. |
| 2015/0045928 | A1 | 2/2015 | Perez et al. |
| 2015/0056421 | A1 | 2/2015 | Yudovin-Farber et al. |
| 2015/0056892 | A1 | 2/2015 | Vacassy et al. |
| 2015/0056895 | A1 | 2/2015 | Fotou et al. |
| 2015/0061170 | A1 | 3/2015 | Engel et al. |
| 2015/0065020 | A1 | 3/2015 | Roy et al. |
| 2015/0084238 | A1 | 3/2015 | Bonassar et al. |
| 2015/0093977 | A1 | 4/2015 | Deopura et al. |
| 2015/0115490 | A1 | 4/2015 | Reinarz |
| 2015/0123298 | A1 | 5/2015 | Napadensky |
| 2015/0126099 | A1 | 5/2015 | Krishnan et al. |
| 2015/0129798 | A1 | 5/2015 | Napadensky |
| 2015/0174826 | A1 | 6/2015 | Murugesh et al. |
| 2015/0216790 | A1 | 8/2015 | Feng et al. |
| 2016/0052103 | A1 | 2/2016 | Qian et al. |
| 2016/0068996 | A1 | 3/2016 | Lau et al. |
| 2016/0101500 | A1 | 4/2016 | Fung et al. |
| 2016/0107287 | A1 | 4/2016 | Bajaj et al. |
| 2016/0107288 | A1 | 4/2016 | Orilall et al. |
| 2016/0107290 | A1 | 4/2016 | Bajaj et al. |
| 2016/0107295 | A1 | 4/2016 | Bajaj et al. |
| 2016/0107381 | A1 | 4/2016 | Krishnan et al. |
| 2016/0114458 | A1 | 4/2016 | Bajaj et al. |
| 2016/0136787 | A1 | 5/2016 | Bajaj et al. |
| 2016/0176021 | A1 | 6/2016 | Orilall et al. |
| 2016/0221145 | A1 | 8/2016 | Huang et al. |
| 2016/0229023 | A1 | 8/2016 | Lugg et al. |
| 2016/0279757 | A1 | 9/2016 | Qian et al. |
| 2016/0354901 | A1 | 12/2016 | Krishnan et al. |
| 2017/0100817 | A1 | 4/2017 | Ganapathiappan et al. |
| 2017/0120416 | A1 | 5/2017 | Chockalingam et al. |
| 2017/0136603 | A1 | 5/2017 | Ganapathiappan et al. |
| 2017/0148539 | A1 | 5/2017 | Prestayko et al. |
| 2017/0151648 | A1 | 6/2017 | Huang et al. |
| 2017/0182629 | A1 | 6/2017 | Lehuu et al. |
| 2017/0203406 | A1* | 7/2017 | Ganapathiappan .... B33Y 10/00 |
| 2017/0203408 | A1 | 7/2017 | Ganapathiappan et al. |
| 2017/0203409 | A1 | 7/2017 | Lefevre et al. |
| 2018/0043613 | A1 | 2/2018 | Krishnan et al. |
| 2018/0161954 | A1 | 6/2018 | Bajaj et al. |
| 2018/0236632 | A1 | 8/2018 | Murugesh et al. |
| 2018/0339402 | A1 | 11/2018 | Redfield et al. |
| 2019/0030678 | A1 | 1/2019 | Kumar et al. |
| 2019/0322031 | A1 | 10/2019 | Kritchman |
| 2020/0001433 | A1 | 1/2020 | Bajaj et al. |

FOREIGN PATENT DOCUMENTS

| | | | |
|---|---|---|---|
| CN | 101612722 | A | 12/2009 |
| CN | 203542340 | U | 4/2014 |
| CN | 103465155 | B | 5/2016 |
| CN | 104400998 | B | 10/2016 |
| CN | 104607639 | B | 11/2016 |
| CN | 104625945 | B | 3/2017 |
| CN | 104385595 | B | 5/2017 |
| CN | 104210108 | B | 11/2017 |
| DE | 19834559 | A1 | 2/2000 |
| DE | 10314075 | B4 | 11/2007 |
| EP | 1419876 | B1 | 4/2008 |
| JP | H0267171 | A | 3/1990 |
| JP | H08132342 | A | 5/1996 |
| JP | H09076353 | A | 3/1997 |
| JP | H11254542 | A | 9/1999 |
| JP | H11347761 | A | 12/1999 |
| JP | 2000061817 | A | 2/2000 |
| JP | 2002151447 | A | 5/2002 |
| JP | 2003303793 | A | 10/2003 |
| JP | 2004235446 | A | 8/2004 |
| JP | 2004243518 | A | 9/2004 |
| JP | 2004281685 | A | 10/2004 |
| JP | 2005074614 | A | 3/2005 |
| JP | 3801100 | B2 | 7/2006 |
| JP | 2006231464 | A | 9/2006 |
| JP | 2007049146 | A | 2/2007 |
| JP | 4693024 | B2 | 6/2011 |
| JP | 4798713 | B2 | 10/2011 |
| JP | 5143528 | B2 | 2/2013 |
| JP | 2013107254 | A | 6/2013 |
| JP | 2016023209 | A | 2/2016 |
| KR | 20030020658 | A | 3/2003 |
| KR | 20050052876 | A | 6/2005 |
| KR | 100842486 | B1 | 7/2008 |
| KR | 20100028294 | A | 3/2010 |
| WO | 9830356 | A1 | 7/1998 |
| WO | 9849723 | A1 | 11/1998 |
| WO | 0164396 | A1 | 9/2001 |
| WO | 0224415 | A1 | 3/2002 |
| WO | 02070200 | A1 | 9/2002 |
| WO | 2007055678 | A2 | 5/2007 |
| WO | 2009158665 | A1 | 12/2009 |
| WO | 2010088246 | A1 | 8/2010 |
| WO | 2012173885 | A2 | 12/2012 |
| WO | 2014039378 | A1 | 3/2014 |
| WO | 2015168529 | A1 | 11/2015 |

OTHER PUBLICATIONS

Andrews, Rodney J., et al.—"Glass Transition Temperatures of Polymers," Polymer Handbook, Fourth Edition, J. Brandrup et al., Editors, A Wiley Interscience Publication, John Wiley & Sons, Inc., 1999, VI / 193-198.

Antje M.J. Van Den Berg, "Inkjet Printing of Polyurethane Colloidal Suspensions", www.rsc.org/softmatter. Jul. 13, 2006.

Byoung-Ho Kwon et al. "Dishing and Ersosion in STI CMP". System IC R&D Center, Hyundai Electronics Industries Co. Ltd. 1999 IEEE. 3 pages.

H. Yang. "High Viscosity Jetting System for 3D Reactive Inkjet Printing", Additive Manufacturing and 3D Printing Group, University of Nottingham. 9 pages.

I Hermant et al. "A Comparative Study of Polyurethane-Poly(Methyl Methacrylate) Interpenetrating and Semi-1 Interprenetrating Polymer Networks", vol. 20, No. 1. pp. 85-89, 1984.

John J. Aklonis et al. "Introduction to Polymer Viscoelasticity". Second Edition. 1983. 6 pages.

Lee M. Cook. "CMP Consumables II: Pad" Chapter 6. Semiconductors and Semimetals, vol. 63. Published 1999. Chemical Mechanical Polishing in Silicon Processing. ISBN: 978-0-12-752172-5.

U.S. Appl. No. 16/906,992, filed Jun. 19, 2020, entitled "Advanced Polishing Pads and Related Polishing Pad Manufacturing Methods."

Peter Freeman et al. "A Study of the Variation of Physical Properties in Random Lots of Urethane Polishing Pads for CMP". A Rodel Publication. vol. 2, Issue 6. Jun. 1996. 8 Pages.

Peter Krober et al. "Reactive Inkjet Printing of Polyurethanes", www.rsc.org/materials. Journal of Materials Chemistry. Jan. 6, 2009.

Plastics in Action; 3-D Printing Speeds Prototype Development dated May/Jun. 1998; 2 total pages.

Rajeev Bajaj et al. "Effect of Polishing Pad Material Properties on Chemical Mechanical Polishing (CMP) Processes". 1994. 8 pages.

Rodel. Rodel IC1000 CMP Pad. 1999. 2 pages.

Rodel. Rodel IC1010. 1998. 2 pages.

S. Raghavan et al. "Chemical Mechanical Planariarization in Integrated Circuit Device Manufacturing". vol. 98-7. 1998. 19 pages.

(56) References Cited

OTHER PUBLICATIONS

Shahrubudin, N., et al.—"An Overview on 3D Printing Technology: Technological, Materials, and Applications," 2nd International Conference on Sustainable Materials Processing and Manufacturing (SMPM 2019), Procedia Manufacturing, 35 (2019), published by Elsevier B.V., pp. 1286-1296.
Sigma-Aldrich—"Thermal Transitions of Homopolymers: Glass Transition & Melting Point" webpage, https://www.sigmaaldrich.com/technical-documents/articles/materials-science/polymer-scie . . . , printed Apr. 8, 2019, 3 pages.
The Dow Chemical Company—"DOW VLDPE DFDB-1085 NT, Very Low Density Polyethylene Resin" Technical Data, UL Prospector, Oct. 2003, 2 pages.
The Dow Chemical Company—"Specialty Elastomers for Automotive TPO Compounds" brochure, Nov. 2006, 8 pages.
Weidan Li et al. "The Effect of the Polishing Pad Treatments on the Chemical-Mechanical Polishing of SiO2 Films", Thin Solid Films 270 (1995). 6 pages.
Whisnaut, David—"Polymer Chemistry: The Glass Transition" webpage, Engineering Libre Texts, https://eng.libretexts.org/Bookshelves/Materials_Schience?Supplemental_Modules_Materia . . . , printed Apr. 10, 2019, 2 pages.
Yu-Lim Jun et al. "Slicing Bitmap Generation and Patterning Technique a SFF System Using UV-Resin", International Conference on Control, Automation and Systems 2007. 5 Pages.

* cited by examiner

POLISHING PADS HAVING SELECTIVELY ARRANGED POROSITY

CROSS-REFERENCE TO RELATED APPLICATIONS

This patent application claims priority to U.S. Provisional Application No. 62/951,938, filed on Dec. 20, 2019, which is herein incorporated by reference in its entirety.

BACKGROUND

Field

Embodiments of the present disclosure generally relate to polishing pads, and methods of manufacturing polishing pads, and more particularly, to polishing pads used for chemical mechanical polishing (CMP) of a substrate in an electronic device fabrication process.

Description of the Related Art

Chemical mechanical polishing (CMP) is commonly used in the manufacturing of high-density integrated circuits to planarize or polish a layer of material deposited on a substrate. A typical CMP process includes contacting the material layer to be planarized with a polishing pad and moving the polishing pad, the substrate, or both, and hence creating relative movement between the material layer surface and the polishing pad, in the presence of a polishing fluid comprising abrasive particles. One common application of CMP in semiconductor device manufacturing is planarization of a bulk film, for example pre-metal dielectric (PMD) or interlayer dielectric (ILD) polishing, where underlying two or three-dimensional features create recesses and protrusions in the surface of the layer to be planarized. Other common applications of CMP in semiconductor device manufacturing include shallow trench isolation (STI) and interlayer metal interconnect formation, where CMP is used to remove the via, contact or trench fill material from the exposed surface (field) of the layer having the STI or metal interconnect features disposed therein.

Often, polishing pads used in the above-described CMP processes are selected based on the material properties of the polishing pad material and the suitability of those material properties for the desired CMP application. One example of a material property that may be adjusted to tune the performance of a polishing pad for a desired CMP application is the porosity of a polymer material used to form the polishing pad and properties related thereto, such as pore size, pore structure, and material surface asperities. Conventional methods of introducing porosity into the polishing pad material typically comprise blending a pre-polymer composition with a porosity forming agent before molding and curing the pre-polymer composition into individual polishing pads or a polymer cake and machining, e.g., skiving, individual polishing pads therefrom. Unfortunately, while conventional methods may allow for the creation of uniform porosity and/or gradual porosity gradients, they are generally unable to provide precision placement of pores within the formed pad and the pad polishing performance-tuning opportunities that might result therefrom.

Accordingly, there is a need in the art for methods of forming discrete respective regions of higher and lower porosity within a polishing pad and polishing pads formed therefrom.

SUMMARY

Embodiments described herein generally relate to polishing pads, and methods for manufacturing polishing pads which may be used in a chemical mechanical polishing (CMP) process, and more particularly, to polishing pad having selectively arranged pores to define discrete regions that include porosity within a polishing element.

In one embodiment, a polishing pad features a plurality of polishing elements each comprising a polishing surface and sidewalls extending downwardly from the polishing surface to define a plurality of channels disposed between the polishing elements. Here, one or more of the polishing elements is formed of a continuous phase of polymer material having one or more first regions comprising a first porosity and a second region comprising a second porosity. Typically, the second porosity is less than the first porosity. In some embodiments, one or more regions of intermediate porosities which have corresponding porosities less than the relatively high porosity region A and more than the relatively low porosity region B may be interposed between the regions A and B. In some embodiments, one or more regions of either higher, lower, or a combination of higher and lower porosities may be interposed between the regions A and B.

In another embodiment, a method of forming a polishing pad includes dispensing droplets of a pre-polymer composition and droplets of a sacrificial material composition onto a surface of a previously formed print layer according to a predetermined droplet dispense pattern. The method further includes at least partially curing the dispensed droplets of the pre-polymer composition to form a print layer comprising at least portions of a polymer pad material having one or more first regions comprising first porosity and one or more second regions comprising a second porosity. At least one of the second regions is disposed adjacent to a first region and the second porosity is less than the first porosity.

BRIEF DESCRIPTION OF THE DRAWINGS

So that the manner in which the above-recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1:
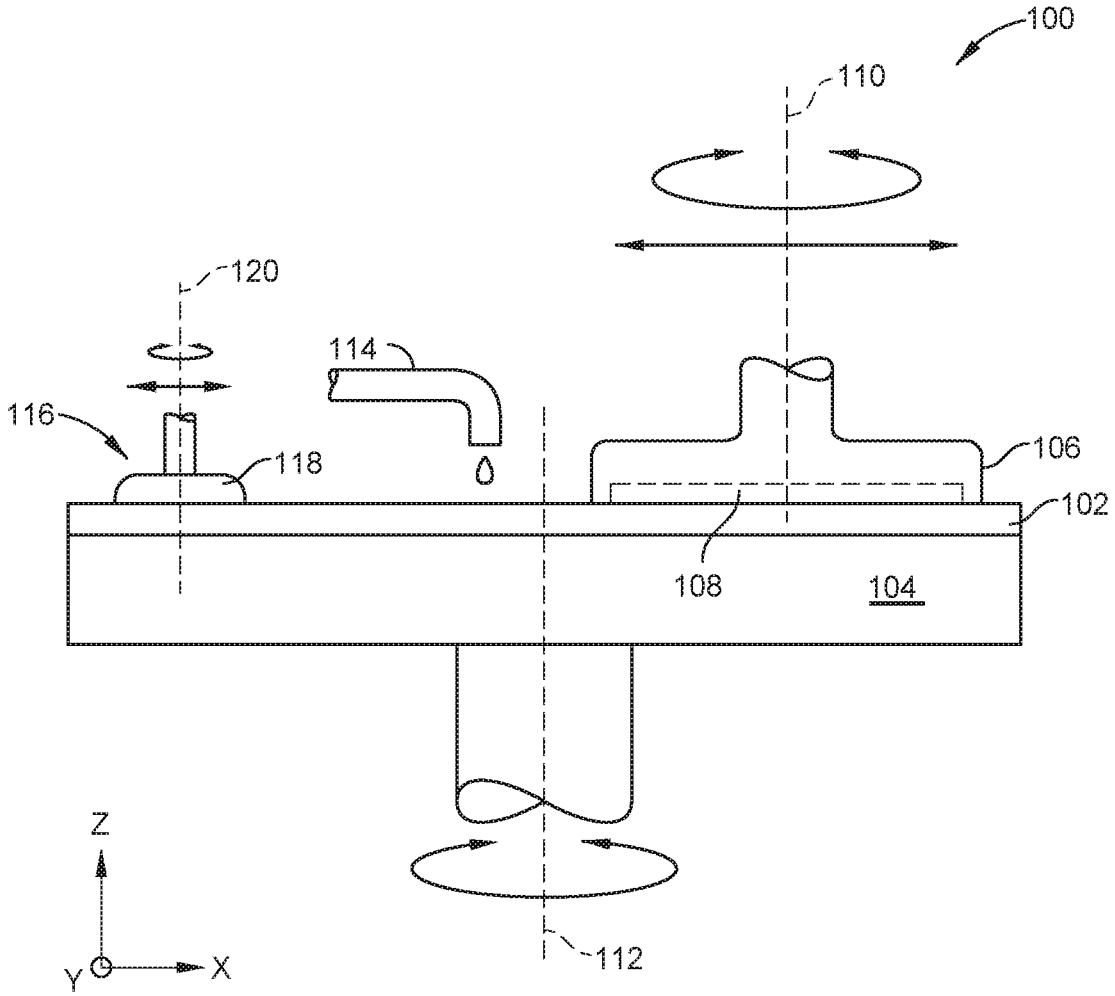
FIG. 1 is a schematic side view of an exemplary polishing system configured to use a polishing pad formed according to one of, or a combination of, the embodiments described herein.

To facilitate understanding, identical reference numerals have been used, where possible, to designate identical elements that are common to the figures. It is contemplated that elements and features of one implementation may be beneficially incorporated in other implementations without further recitation.

DETAILED DESCRIPTION

Embodiments described herein generally relate to polishing pads, and methods for manufacturing polishing pads, which may be used in a chemical mechanical polishing (CMP) process, and more particularly, to polishing pads having selectively arranged pores to define discrete regions that include porosity within a polishing element.

Generally, the polishing pads described herein feature a foundation layer and a plurality of polishing elements disposed on, and integrally formed with, the foundation layer to form a unitary body comprising a continuous polymer phase. The polishing elements form a polishing surface of the polishing pad and the foundation layer provides support for the polishing elements as a to-be-polished substrate is urged against the polishing surface.

The polishing elements feature pores that are selectively arranged across the polishing surface and/or in a direction orthogonal thereto. As used herein, the term "pore" includes openings defined in the polishing surface, voids formed in the polishing material below the polishing surface, pore-forming features disposed in the polishing surface, and pore-forming features disposed in polishing material below the polishing surface. Pore-forming features typically comprise a water-soluble-sacrificial material that dissolves upon exposure to a polishing fluid thus forming a corresponding opening in the polishing surface and/or void in the polishing material below the polishing surface. In some embodiments, the water-soluble-sacrificial material may swell upon exposure to a polishing fluid thus deforming the surrounding polishing material to provide asperities at the polishing pad material surface. The resulting pores and asperities desirably facilitate transporting liquid and abrasives to the interface between the polishing pad and a to-be-polished material surface of a substrate, and temporarily fixes those abrasives (abrasive capture) in relation to the substrate surface to enable chemical and mechanical material removal therefrom.

The term "selectively arranged pores" as used herein refers to the distribution of pores within the polishing elements. Herein, the pores are distributed in one or both directions of an X-Y plane parallel to the polishing surface of the polishing pad (i.e., laterally) and in a Z-direction which is orthogonal to the X-Y planes, (i.e., vertically).

FIG. 1 is a schematic side view of an example polishing system configured to use a polishing pad formed according to one or a combination of the embodiments described herein. Here, the polishing system 100 features a platen 104, having a polishing pad 102 secured thereto using a pressure sensitive adhesive, and a substrate carrier 106. The substrate carrier 106 faces the platen 104 and the polishing pad 102 mounted thereon. The substrate carrier 106 is used to urge a material surface of a substrate 108, disposed therein, against the polishing surface of the polishing pad 102 while simultaneously rotating about a carrier axis 110. Typically, the platen 104 rotates about a platen axis 112 while the rotating substrate carrier 106 sweeps back and forth from an inner diameter to an outer diameter of the platen 104 to, in part, reduce uneven wear of the polishing pad 102.

The polishing system 100 further includes a fluid delivery arm 114 and a pad conditioner assembly 116. The fluid delivery arm 114 is positioned over the polishing pad 102 and is used to deliver a polishing fluid, such as a polishing slurry having abrasives suspended therein, to a surface of the polishing pad 102. Typically, the polishing fluid contains a pH adjuster and other chemically active components, such as an oxidizing agent, to enable chemical mechanical polishing of the material surface of the substrate 108. The pad conditioner assembly 116 is used to condition the polishing pad 102 by urging a fixed abrasive conditioning disk 118 against the surface of the polishing pad 102 before, after, or during polishing of the substrate 108. Urging the conditioning disk 118 against the polishing pad 102 includes rotating the conditioning disk 118 about an axis 120 and sweeping the conditioning disk 118 from an inner diameter the platen 104 to an outer diameter of the platen 104. The conditioning disk 118 is used to abrade, rejuvenate, and remove polish byproducts or other debris from, the polishing surface of the polishing pad 102.

Figure 2A:
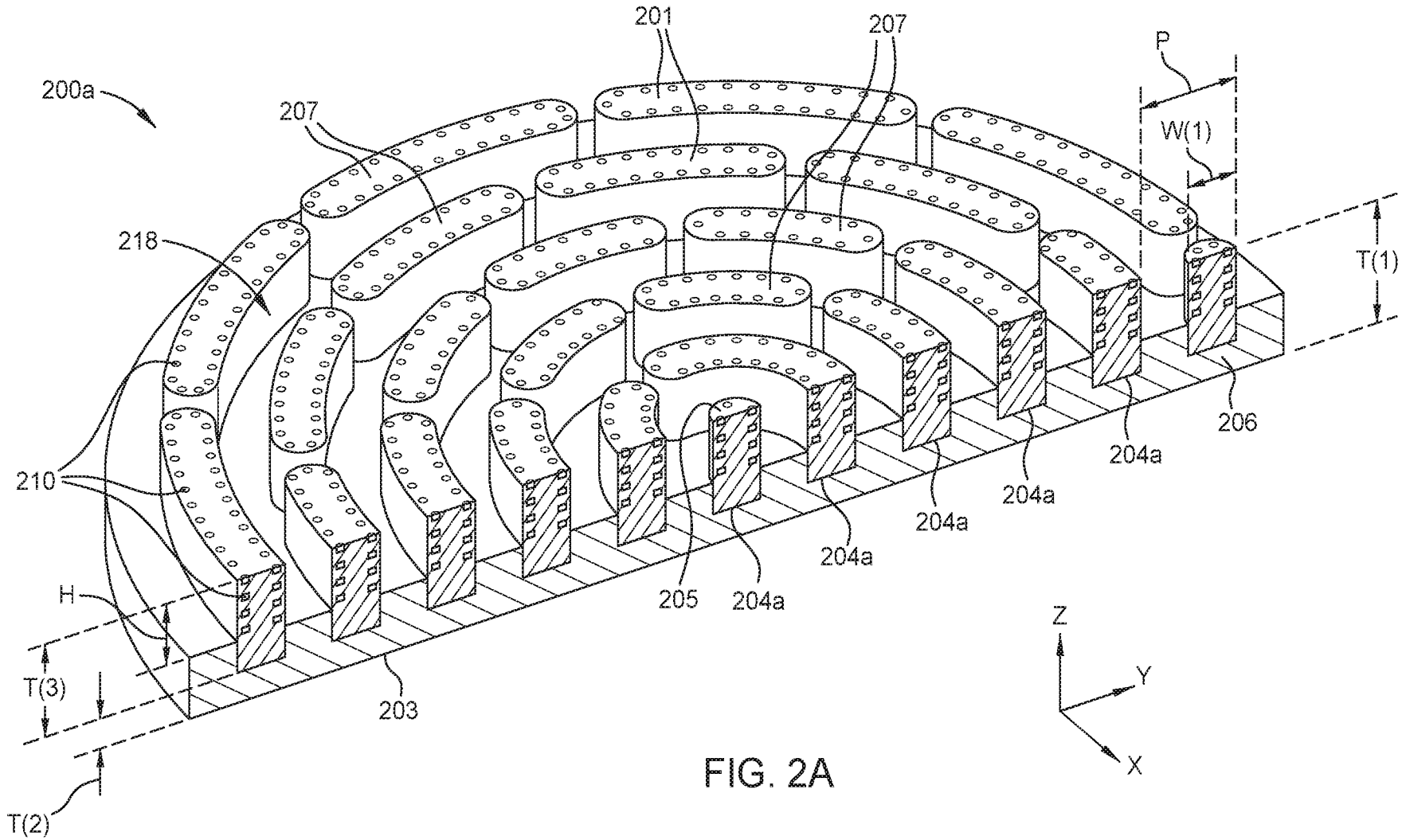
FIG. 2A is a schematic perspective sectional view of a polishing pad featuring selectively arranged pores, according to one embodiment.

FIG. 2A is a schematic perspective sectional view of a polishing pad 200*a* featuring selectively arranged pores, according to one embodiment. The polishing pad 200*a* may be used as the polishing pad 102 of the exemplary polishing system 100 described in FIG. 1. Here, the polishing pad 200*a* comprises a plurality of polishing elements 204*a*, which are disposed on and partially disposed within a foundation layer 206. The polishing pad 200*a* has a first thickness T(1) of between about 5 mm and about 30 mm. The polishing elements 204*a* are supported in the thickness direction of the pad 200*a* by a portion of the foundation layer 206 that has a second thickness of T(2) of between about ⅓ to about ⅔ of the first thickness T(1). The polishing elements 204*a* have a third thickness T(3) that is between about ⅓ and about ⅔ the thickness T(1). As shown, at least portions of the polishing elements are disposed beneath a surface of the foundation layer 206 and the remaining portions extend upwardly therefrom by a height H. In some embodiments, the height H is about ½ the first thickness T(1) or less.

Here, the plurality of polishing elements 204*a* comprise a plurality of discontinuous (segmented) concentric rings 207 disposed about a post 205 and extending radially outward therefrom. Here, the post 205 is disposed in the center of the polishing pad 200*a*. In other embodiments the center of the post 205, and thus the center of the concentric rings 207, may be offset from the center of the polishing pad 200*a* to provide a wiping type relative motion between a substrate and the polishing pad surface as the polishing pad 200*a* rotates on a polishing platen. Sidewalls of the plurality of polishing elements 204*a* and an upward facing surface of the foundation layer 206 define a plurality of channels 218 disposed in the polishing pad 200*a* between each of the polishing elements 204*a* and between a plane of the polishing surface of the polishing pad 200*a* and a surface of the foundation layer 206. The plurality of channels 218 enable the distribution of polishing fluids across the polishing pad 200*a* and to an interface between the polishing pad 200*a* and the material surface of a substrate to be polished thereon. Here, the polishing elements 204*a* have an upper surface that is parallel to the X-Y plane and sidewalls that are substantially vertical, such as within about 20° of vertical (orthogonal to the X-Y plane), or within 10° of vertical. A width W(1) of the polishing element(s) 204*a* is between about 250 microns and about 10 millimeters, such as between about 250 microns and about 5 millimeters, or between about 1 mm and about 5 mm. A pitch P between the polishing element(s) 204*a* is between about 0.5 millimeters and about 5 millimeters. In some embodiments, one or both of the width W(1) and the pitch P vary across a radius of the polishing pad 200*a* to define zones of pad material properties.

FIGS. 2B-2I are schematic sectional views of polishing elements 204*b-i* that illustrate various selective pore arrangements. Any one or combination of the selective pore arrangements shown and described in FIGS. 2B-2I may be used with, and/or in place of, the selective pore arrangements of the polishing elements 204*a* of FIG. 2A. As shown in FIGS. 2B-2I, each of the polishing elements 204*b-i* are formed of a continuous phase of polymer material 212 comprising relatively high porosity regions A and one or more relatively low porosity regions B disposed adjacent thereto. As used herein, "porosity" refers to the volume of void-space as a percentage of the total bulk volume in a given sample. In embodiments where a pore, as defined herein, comprises a pore-forming feature formed of a sacrificial material the porosity is measured after sacrificial material forming the feature is dissolved therefrom. Porosity and pore size may be measured using any suitable method, such as by methods using scanning election microscopy (SEM) or optical microscope. Techniques and systems for characterizing porosity (e.g., area density) and pore size are well known in the art. For example, a portion of the surface can be characterized by any suitable method (e.g., by electron microscope image analysis, by atomic force microscopy, by 3D microscopy, etc.). In one implementation, the porosity (e.g., percentage or ratio of the exposed pore area to exposed non-pore containing area of a sample's surface) and pore size analysis can be performed using a VK-X Series 3D UV Laser Scanning Confocal Microscope, produced by KEYENCE Corporation of America, located in Elmwood Park, N.J., U.S.A.

Typically, the porosity in a region of relatively high porosity A will be about 3% or more, such as about 4% or more, about 5% or more, about 10% or more, about 12.5% or more, about 15% or more, about 17.5% or more, about 20% or more, about 22.5% or more, or about 25% or more. The porosity in a relatively low porosity region B will generally be about 95% or less than the porosity of the region of relatively high porosity A adjacent thereto, such as about 90% or less, about 85% or less, about 80% or less, about 75% or less, about 70% or less, about 60% or less, about 50% or less, about 40% or less, about 30% or less, or about 25% or less. In some embodiments, the relatively low porosity region B will have substantially no porosity. Herein, substantially no porosity comprises regions having a porosity of about 0.5% or less. In some embodiments, the relatively low porosity region B will have a porosity of 0.1% or less.

In some embodiments, such as shown in FIGS. 2B-2E, the relatively high porosity regions A comprise a plurality of pores 210 disposed proximate to one or more of the sidewalls of the polishing elements 204*a-e* (when viewed from top down). The regions of relatively low (or substantially no) porosity B are disposed inwardly from the sidewalls of the polishing elements 204*a-e*, i.e., inwardly from the relatively high porosity regions A (when viewed from top down). Here, the relatively high porosity regions A have a width W(2) that is less than the width W(3) of the relatively low porosity region B disposed adjacent thereto. In some embodiments, one or more of the relatively high porosity regions A have a width W(2) in the range of about 50 μm to about 10 mm, such as about 50 μm to about 8 mm, about 50 μm to about 6 mm, about 50 μm to about 5.5 mm, about 50 μm to about 5 mm, about 50 μm to about 4 mm, about 50 μm to about 3 mm, about 50 μm to about 2 mm, such as about 50 μm to about 1.5 mm, about 50 μm to about 1 mm, about 100 μm to about 1 mm, or about 200 μm to about 1 mm. In some embodiments, the width W(2) of the region of relatively high porosity A is about 90% or less of the width of the region of relatively low porosity B disposed adjacent thereto, such as 80% or less, 70% or less, 60% or less, or 50% or less. As shown, the relatively high porosity region A is adjacent to the relatively low porosity region B. In some embodiments, one or more regions of intermediate porosity (not shown) which has a porosity less than the relatively high porosity region A and more than the relatively low porosity region B may be interposed between the regions A and B.

Typically, the pores 210 used to form the relatively high porosity regions A will have one or more lateral (X-Y) dimensions which are about 500 μm or less, such as about 400 μm or less, 300 μm or less, 200 μm or less, or 150 μm or less. In some embodiments, the pores 210 will have at least one lateral dimension that is about 5 μm or more, about 10 μm or more, about 25 μm or more, or about 50 μm or more. In some embodiments, the pores will have at least one lateral dimension in the range of about 50 μm to about 250 μm, such as in the range of about 50 μm to about 200 μm, about 50 μm to about 150 μm. A pore height Z-dimension may be about 1 μm or more, about 2 μm or more, about 3 μm or more, about 5 μm or more, about 10 μm or more, such as about 25 μm or more, about 50 μm or more, about 75 μm, or about 100 μm. In some embodiments, the pore height Z-dimension is about 100 μm or less, such as between about 1 μm and about 50 μm, or between about 1 μm and about 25 μm, such as between about 1 μm and about 10 μm.

As shown in FIGS. 2A-2I the relatively high porosity regions A extend from the surface of the polishing elements 204*a* to a depth D which may be the same as the height H (FIG. 2A) or the thickness T(3) of the polishing elements 204*a-i* or may be a fraction thereof. For example, in some embodiments, the relatively high porosity regions A may extend to a depth D that is 90% or less of the thickness T(3), such as about 80% or less, 70% or less, 60% or less, or 50% or less. In some embodiments, the relatively high porosity regions A may extend to a depth D that is about 90% or less of the height H of the polishing element 204*a-i*, such as 80% or less, 70% or less, 60% or less, or 50% or less.

Figure 2B:
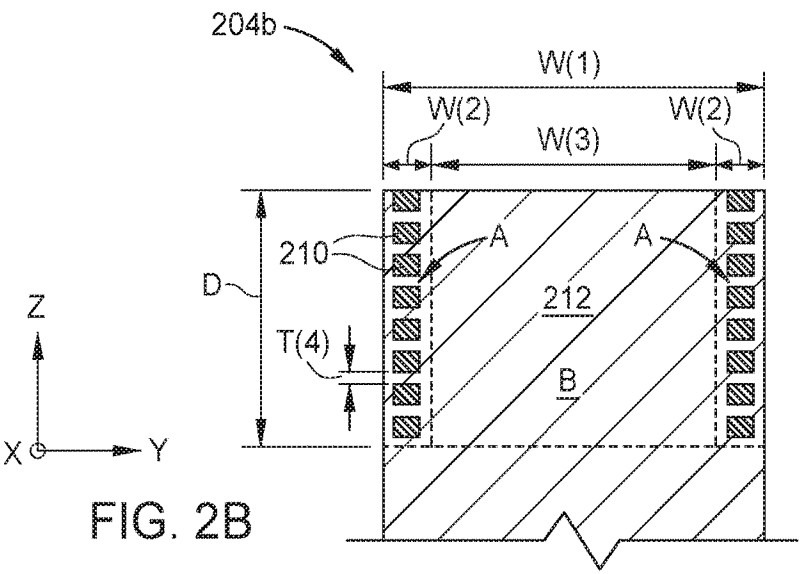
FIGS. 2B-2I are schematic sectional views of polishing elements that illustrate various selective pore arrangements.
Figure 2C:
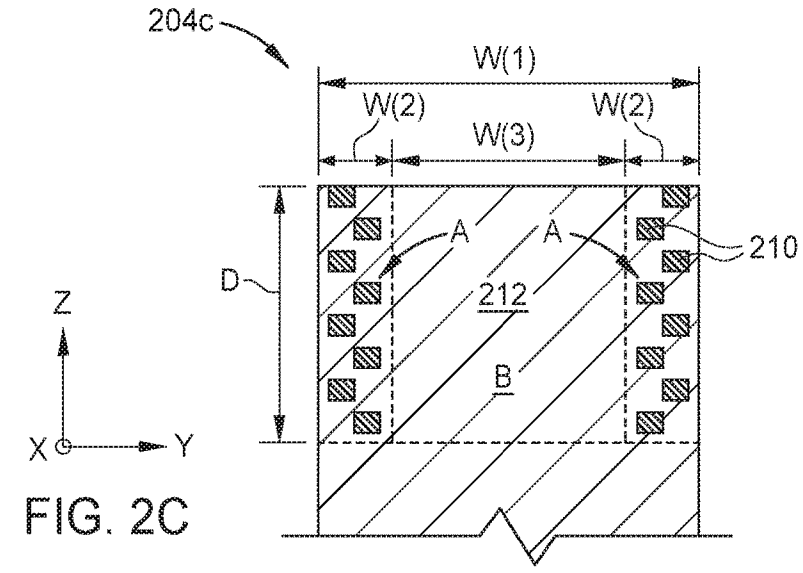
Figure 2D:
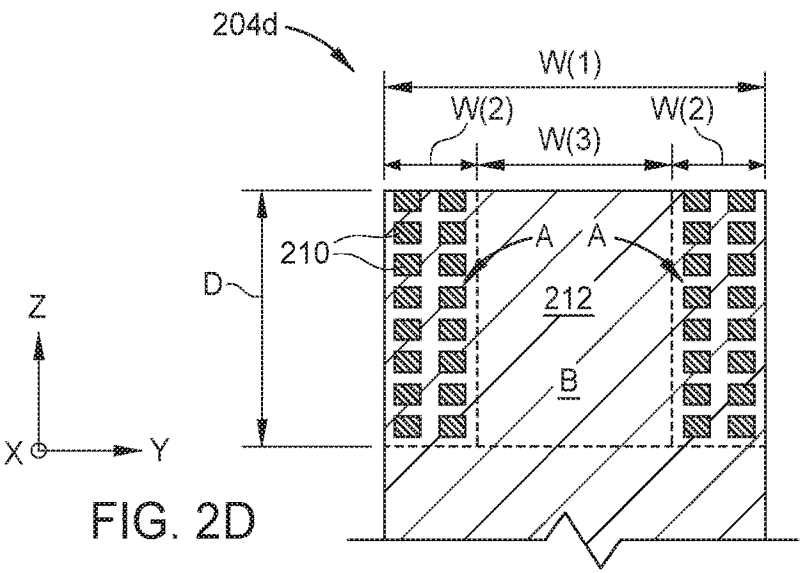
Figure 2E:
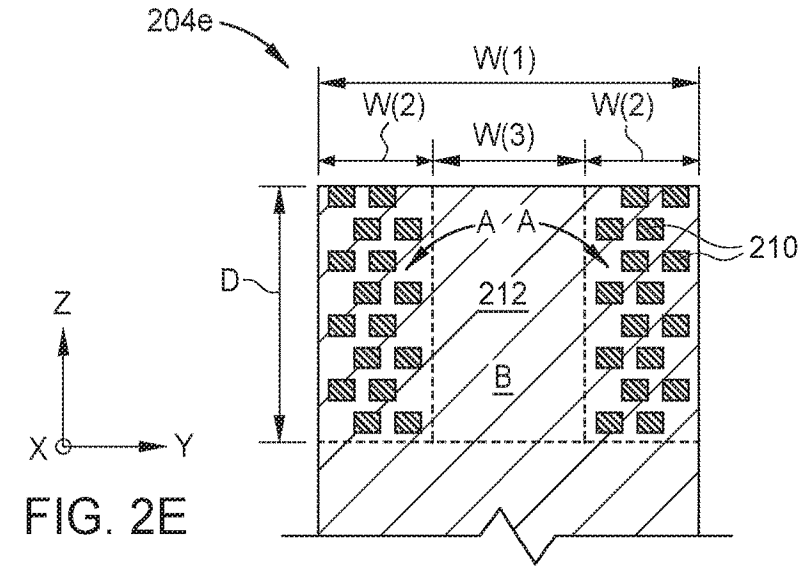
Figure 2F:
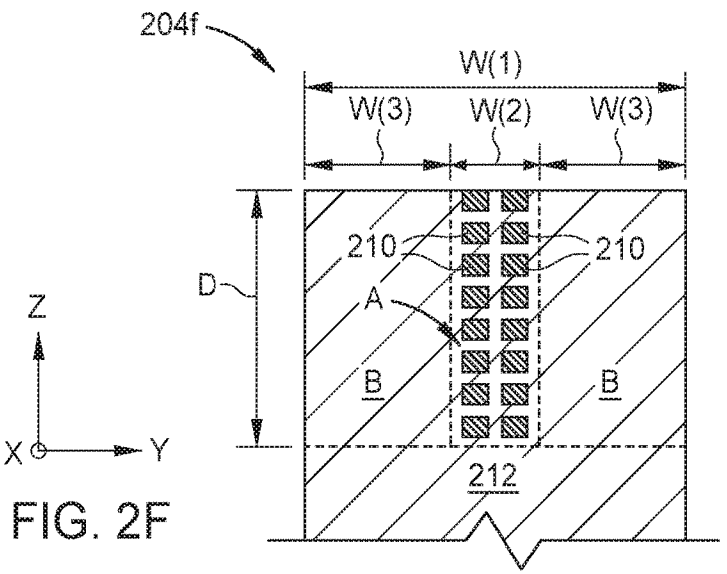
Figure 2G:
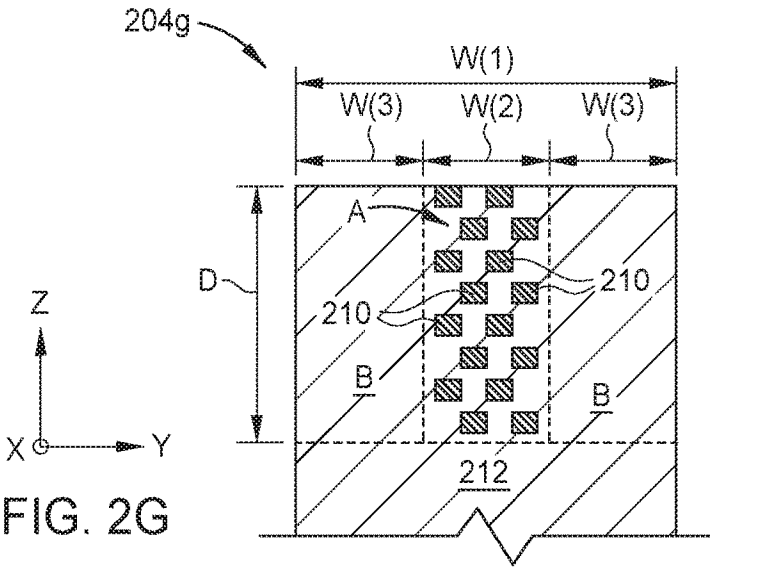

The pores 210 used to form the relatively high porosity regions A may be disposed in any desired vertical arrangement when viewed in cross-section. For example, in some embodiments, the pores 210 may be vertically disposed in one or more columnar arrangements such as shown in FIGS. 2B, 2D where the pores 210 in each of the columns are in substantial vertical alignment. In other embodiments, the pores 210 may be vertically disposed in one or more staggered columnar arrangements where each pore 210 is offset in one or both of the X-Y directions with respect to a pore 210 that is disposed thereabove and/or therebelow. The orientation of the pores in a columnar arrangement can be used to adjust the compliance of the porosity region A, due to the relative alignment or non-alignment of the pores to a direction in which a load is provided during polishing by a substrate that is being polished. Thus, in one example, the columnar arrangement of pores can be used to adjust and/or control the polishing planarization results for a formed polishing pad.

Here, the pores 210 are spaced apart in the vertical direction by one or more printed layers of the polymer material 212 that has a total thickness T(4) of the one or more printed layers of about 5 μm or more, such as about 10 μm or more, 20 μm or more, 30 μm or more, 40 μm or more, or 50 μm or more. In one example, spacing between pores 210 in a vertical direction in polishing feature is about 40 μm. In this example, the 40 μm spacing can be formed by disposing three or four layers of the polymer material 212 between printed layers that include the pores 210. Thus, as shown, the pores 210 form a substantially closed-celled structure. In other embodiments one or more of the pores 210, or portions thereof, are not spaced apart from one or more of the pores adjacent thereto and thus form a more open-celled structure.

Figure 2H:
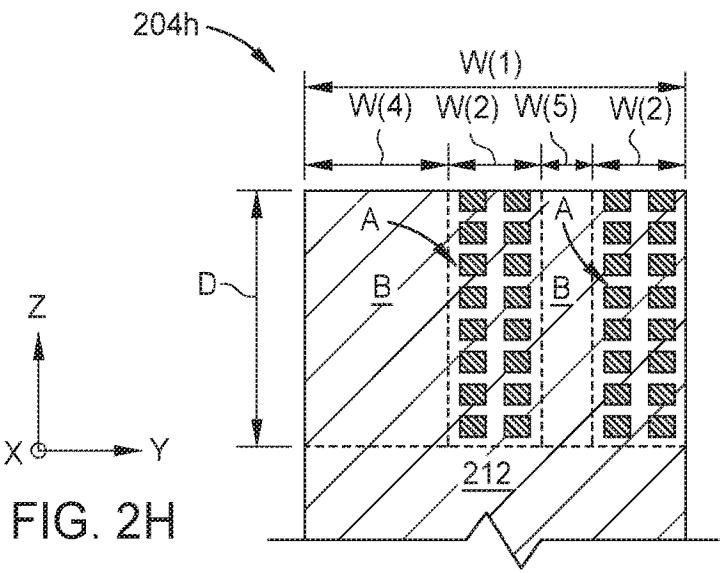
Figure 2I:
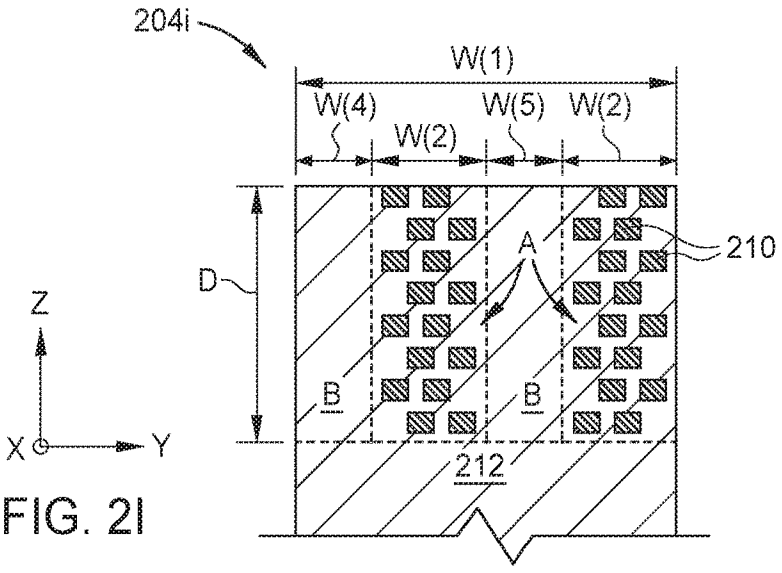

In some embodiments, such as shown in FIGS. 2F-2I, the polishing elements 200*f-i* comprise at least one relatively low porosity region B disposed proximate to the sidewall of the polishing element 204*f-i* and at least one adjacent relatively high porosity region A disposed inwardly therefrom. In some embodiments, such as shown in FIGS. 2H-2I, the polishing elements 204*h-i* alternating relatively high porosity regions A and relatively low porosity regions B. In those embodiments, each of the high porosity regions A may have the same width W(2), as shown, or have different widths (not shown). The alternating high porosity regions A are spaced apart by a low porosity region B and each of the low porosity regions B may have the same width (not shown) or different widths, such as W(4) and W(5) respectively where the widths W(4) and W(5) may be found the ranges set forth above for the width W(3).

FIGS. 3A-3F are schematic plan views of various polishing elements 304*a-f* shapes which may be used with or in place of the polishing elements 204*a* of the polishing pad 200*a* described in FIG. 2A. Each of the FIGS. 3A-3F include pixel charts having white regions (regions in white pixels) that represent the polishing elements 304*a-f* and black regions (regions in black pixels) that represent the foundation layer 206. Pores and related high porosity regions (not shown in FIGS. 3A-3F) comprise any one or combination of the selective pore arrangements set forth in FIGS. 2B-2I above.

Figure 3A:
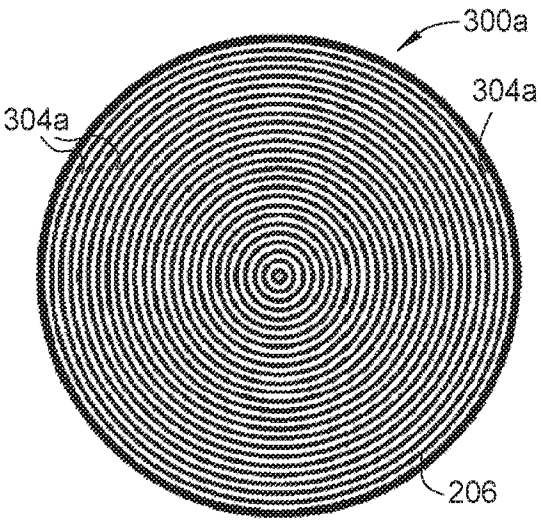
FIGS. 3A-3F are schematic plan view of various polishing pad designs which may be used in place of the pad design shown in FIG. 2A, according to some embodiments.
Figure 3B:
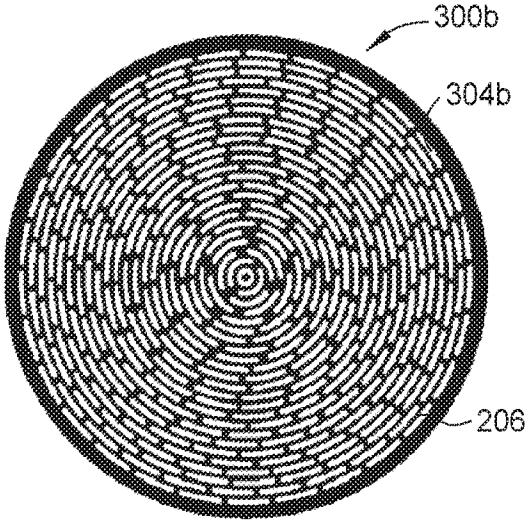
Figure 3C:
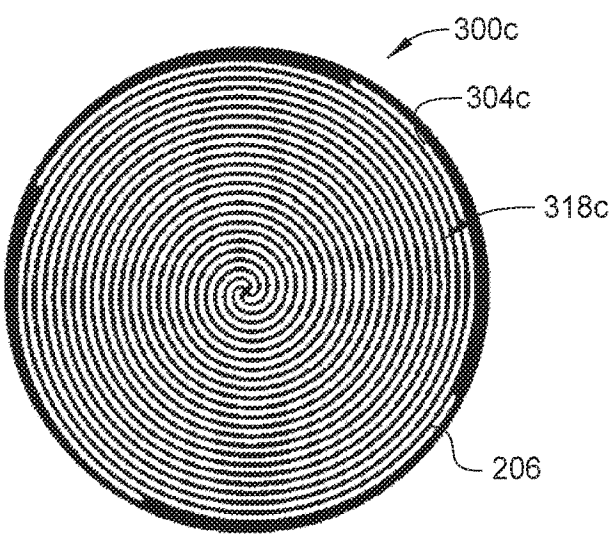
Figure 3D:
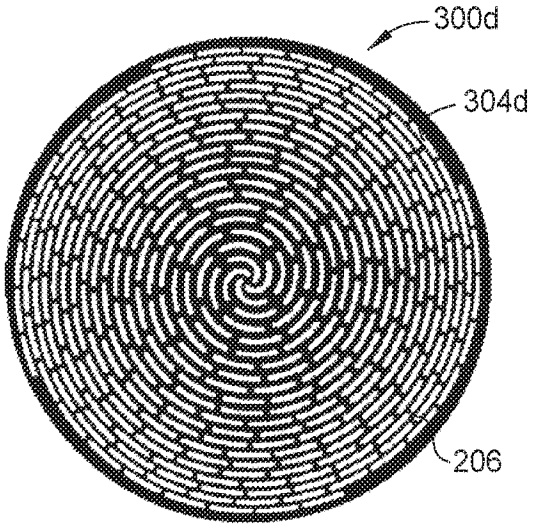

In FIG. 3A, the polishing elements 300*a* comprise a plurality of concentric annular rings. In FIG. 3B, the polishing elements 300*b* comprise a plurality of segments of concentric annular rings. In FIG. 3C, the polishing elements 304*c* form a plurality of spirals (four shown) extending from a center of the polishing pad 300*c* to an edge of the polishing pad 300*c* or proximate thereto. In FIG. 3D, a plurality of discontinuous polishing elements 304*d* are arranged in a spiral pattern on the foundation layer 206.

Figure 3E:
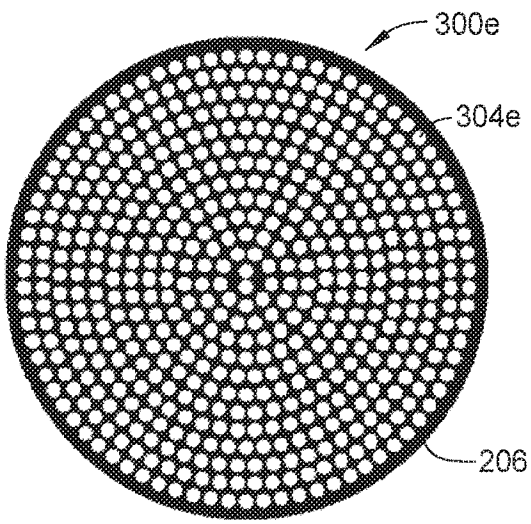
Figure 3F:
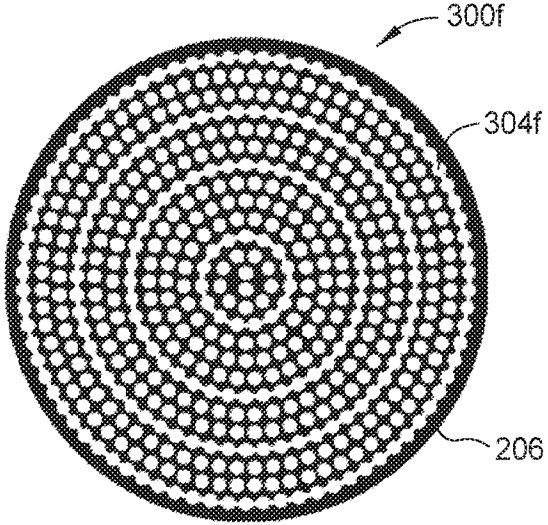

In FIG. 3E, each of the plurality of polishing elements 304*e* comprise a cylindrical post extending upwardly from the foundation layer 206. In other embodiments, the polishing elements 304*e* are of any suitable cross-sectional shape, for example columns with toroidal, partial toroidal (e.g., arc), oval, square, rectangular, triangular, polygonal, irregular shapes in a section cut generally parallel to the underside surface of the pad 300*e*, or combinations thereof. FIG. 3F illustrates a polishing pad 300*f* having a plurality of discrete polishing elements 304*f* extending upwardly from the foundation layer 206. The polishing pad 300*f* of FIG. 3F is similar to the polishing pad 300*e* except that some of the polishing elements 304*f* are connected to form one or more closed circles. The one or more closed circles create damns to retain polishing fluid during a CMP process.

Figure 4A:
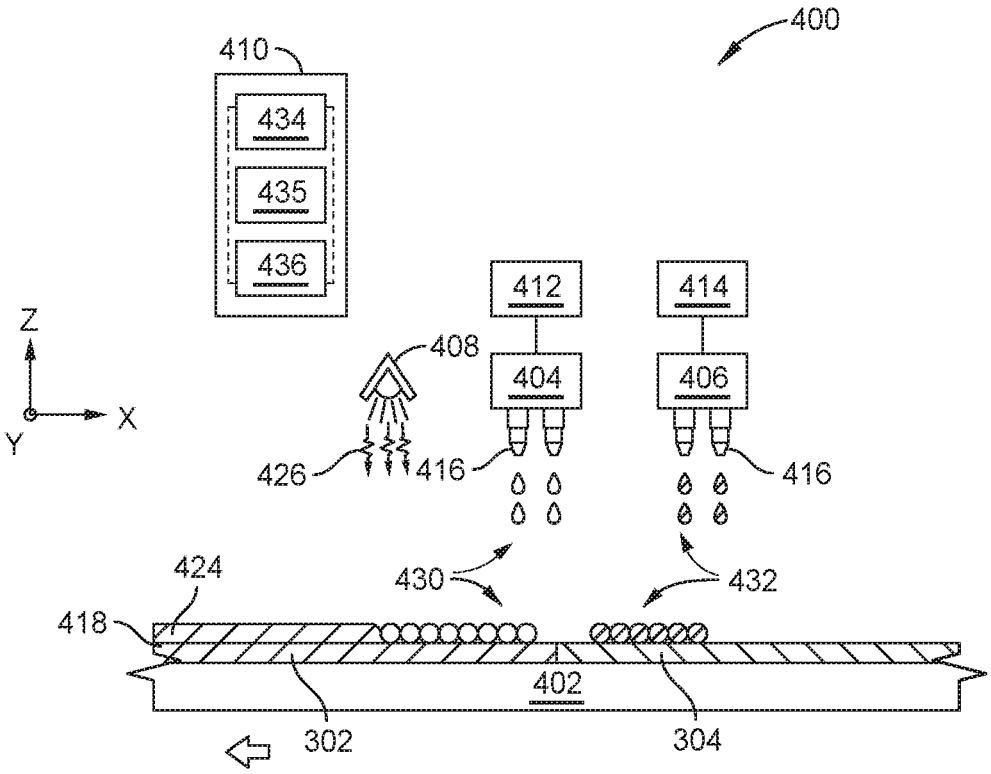
FIG. 4A is a schematic sectional view of an additive manufacturing system, which may be used to form the polishing pads described herein.

FIG. 4A is a schematic sectional view of an additive manufacturing system, which may be used to form the polishing pads described herein, according to some embodiments. Here, the additive manufacturing system 400 features a movable manufacturing support 402, a plurality of dispense heads 404 and 406 disposed above the manufacturing support 402, a curing source 408, and a system controller 410. In some embodiments, the dispense heads 404, 406 move independently of one another and independently of the manufacturing support 402 during the polishing pad manufacturing process. Here, the first and second dispense heads 404 and 406 are respectively fluidly coupled to a first pre-polymer composition source 412 and sacrificial material sources 414 which are used to form the polymer material 212 and the pores 210 described in FIGS. 2A-2I above. Typically, the additive manufacturing system 400 will feature at least one more dispense head (e.g., a third dispense head, not shown) which is fluidly coupled to a second pre-polymer composition source used to form the foundation layer 206 described above. In some embodiments, the additive manufacturing system 400 includes as many dispense heads as desired to each dispense a different pre-polymer composition or sacrificial material precursor compositions. In some embodiments, the additive manufacturing system 400 further comprises pluralities of dispense heads where two or more dispense heads are configured to dispense the same pre-polymer compositions or sacrificial material precursor compositions.

Here, each of dispense heads 404, 406 features an array of droplet ejecting nozzles 416 configured to eject droplets 430, 432 of the respective pre-polymer composition 412 and sacrificial material composition 414 delivered to the dispense head reservoirs. Here, the droplets 430, 432 are ejected towards the manufacturing support and thus onto the manufacturing support 402 or onto a previously formed print layer 418 disposed on the manufacturing support 402. Typically, each of dispense heads 404, 406 is configured to fire (control the ejection of) droplets 430, 432 from each of the nozzles 416 in a respective geometric array or pattern independently of the firing other nozzles 416 thereof. Herein, the nozzles 416 are independently fired according to a droplet dispense pattern for a print layer to be formed, such as the print layer 424, as the dispense heads 404, 406 move relative to the manufacturing support 402. Once dispensed, the droplets 430 of the pre-polymer composition and/or the droplets of the sacrificial material composition 414 are at least partially cured by exposure to electromagnetic radiation, e.g., UV radiation 426, provided by an electromagnetic radiation source, such as a UV radiation source 408 to form a print layer, such as the partially formed print layer 424.

Figure 4B:
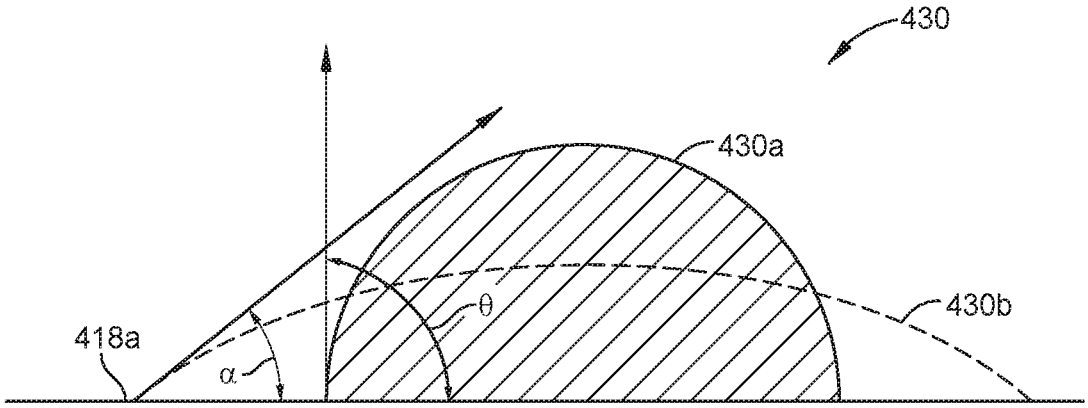
FIG. 4B is a close-up cross-sectional view schematically illustrating a droplet disposed on a surface of a previously formed print layer, according to one or more, or a combination of, the embodiments described herein.

In some embodiments, dispensed droplets of the pre-polymer compositions, such as the dispensed droplets 430 of the first pre-polymer composition, are exposed to electromagnetic radiation to physically fix the droplet before it spreads to an equilibrium size such as set forth in the description of FIG. 4B. Typically, the dispensed droplets are exposed to electromagnetic radiation to at least partially cure the pre-polymer compositions thereof within 1 second or less of the droplet contacting a surface, such as the surface of the manufacturing support 402 or of a previously formed print layer 418 disposed on the manufacturing support 402.

FIG. 4B is a close up cross-sectional view schematically illustrating a droplet 430 disposed on a surface 418*a* of a previously formed layer, such as the previously formed layer 418 described in FIG. 4A, according to some embodiments.

In a typically additive manufacturing process, a droplet of pre-polymer composition, such as the droplet 430*a* will spread and reach an equilibrium contact angle α with the surface 418*a* of a previously formed layer within about one second from the moment in time that the droplet 430*a* contacts the surface 418*a*. The equilibrium contact angle α is a function of at least the material properties of the pre-polymer composition and the energy at the surface 418*a* (surface energy) of the previously formed layer, e.g., previously formed layer 418. In some embodiments, it is desirable to at least the partially cure the dispensed droplet before it reaches an equilibrium size in order to fix the droplets contact angle with the surface 418*a* of the previously formed layer. In those embodiments, the fixed droplet's 430*b* contact angle θ is greater than the equilibrium contact angle α of the droplet 430*a* of the same pre-polymer composition which was allowed to spread to its equilibrium size.

Herein, at least partially curing a dispensed droplet causes the at least partial polymerization, e.g., the cross-linking, of the pre-polymer composition(s) within the droplets and with adjacently disposed droplets of the same or different pre-polymer composition to form a continuous polymer phase. In some embodiments, the pre-polymer compositions are dispensed and at least partially cured to form a well about a desired pore before a sacrificial material composition is dispensed thereinto.

The pre-polymer compositions used to form the foundation layer 206 and the polymer material 212 of the polishing elements described above each comprise a mixture of one or more of functional polymers, functional oligomers, functional monomers, reactive diluents, and photoinitiators.

Examples of suitable functional polymers which may be used to form one or both of the at least two pre-polymer compositions include multifunctional acrylates including di, tri, tetra, and higher functionality acrylates, such as 1,3,5-triacryloylhexahydro-1,3,5-triazine or trimethylolpropane triacrylate.

Examples of suitable functional oligomers which may be used to form one or both of the at least two pre-polymer compositions include monofunctional and multifunctional oligomers, acrylate oligomers, such as aliphatic urethane acrylate oligomers, aliphatic hexafunctional urethane acrylate oligomers, diacrylate, aliphatic hexafunctional acrylate oligomers, multifunctional urethane acrylate oligomers, aliphatic urethane diacrylate oligomers, aliphatic urethane acrylate oligomers, aliphatic polyester urethane diacrylate blends with aliphatic diacrylate oligomers, or combinations thereof, for example bisphenol-A ethoxylate diacrylate or polybutadiene diacrylate, tetrafunctional acrylated polyester oligomers, and aliphatic polyester based urethane diacrylate oligomers.

Examples of suitable monomers which may be used to form one or both of the at least two pre-polymer compositions include both mono-functional monomers and multifunctional monomers. Suitable mono-functional monomers include tetrahydrofurfuryl acrylate (e.g. SR285 from Sartomer®), tetrahydrofurfuryl methacrylate, vinyl caprolactam, isobornyl acrylate, isobornyl methacrylate, 2-phenoxyethyl acrylate, 2-phenoxyethyl methacrylate, 2-(2-ethoxyethoxy)ethyl acrylate, isooctyl acrylate, isodecyl acrylate, isodecyl methacrylate, lauryl acrylate, lauryl methacrylate, stearyl acrylate, stearyl methacrylate, cyclic trimethylolpropane formal acrylate, 2-[[(Butylamino) carbonyl] oxy]ethyl acrylate (e.g. Genomer 1122 from RAHN USA Corporation), 3,3,5-trimethylcyclohexane acrylate, or mono-functional methoxylated PEG (350) acrylate. Suitable multifunctional monomers include diacrylates or dimethacrylates of diols and polyether diols, such as propoxylated neopentyl glycol diacrylate, 1,6-hexanediol diacrylate, 1,6-hexanediol dimethacrylate, 1,3-butylene glycol diacrylate, 1,3-butylene glycol dimethacrylate 1,4-butanediol diacrylate, 1,4-butanediol dimethacrylate, alkoxylated aliphatic diacrylate (e.g., SR9209A from Sartomer®), diethylene glycol diacrylate, diethylene glycol dimethacrylate, dipropylene glycol diacrylate, tripropylene glycol diacrylate, triethylene glycol dimethacrylate, alkoxylated hexanediol diacrylates, or combinations thereof, for example SR562, SR563, SR564 from Sartomer®.

Typically, the reactive diluents used to form one or more of the pre-polymer compositions are least monofunctional, and undergo polymerization when exposed to free radicals, Lewis acids, and/or electromagnetic radiation. Examples of suitable reactive diluents include monoacrylate, 2-ethylhexyl acrylate, octyldecyl acrylate, cyclic trimethylolpropane formal acrylate, caprolactone acrylate, isobornyl acrylate (IBOA), or alkoxylated lauryl methacrylate.

Examples of suitable photoinitiators used to form one or more of the at least two different pre-polymer compositions include polymeric photoinitiators and/or oligomer photoinitiators, such as benzoin ethers, benzyl ketals, acetyl phenones, alkyl phenones, phosphine oxides, benzophenone compounds and thioxanthone compounds that include an amine synergist, or combinations thereof.

Examples of polishing pad materials formed of the pre-polymer compositions described above typically include at least one of oligomeric and, or, polymeric segments, compounds, or materials selected from the group consisting of: polyamides, polycarbonates, polyesters, polyether ketones, polyethers, polyoxymethylenes, polyether sulfone, polyetherimides, polyimides, polyolefins, polysiloxanes, polysulfones, polyphenylenes, polyphenylene sulfides, polyurethanes, polystyrene, polyacrylonitriles, polyacrylates, polymethylmethacrylates, polyurethane acrylates, polyester acrylates, polyether acrylates, epoxy acrylates, polycarbonates, polyesters, melamines, polysulfones, polyvinyl materials, acrylonitrile butadiene styrene (ABS), halogenated polymers, block copolymers, and random copolymers thereof, and combinations thereof.

The sacrificial material composition(s), which may be used to form the pores 210 described above, include water-soluble material, such as, glycols (e.g., polyethylene glycols), glycol-ethers, and amines. Examples of suitable sacrificial material precursors which may be used to form the pore forming features described herein include ethylene glycol, butanediol, dimer diol, propylene glycol-(1,2) and propylene glycol-(1,3), octane-1,8-diol, neopentyl glycol, cyclohexane dimethanol (1,4-bis-hydroxymethylcyclohexane), 2-methyl-1,3-propane diol, glycerine, trimethylolpropane, hexanediol-(1,6), hexanetriol-(1,2,6) butane triol-(1,2,4), trimethylolethane, pentaerythritol, quinitol, mannitol and sorbitol, methylglycoside, also diethylene glycol, triethylene glycol, tetraethylene glycol, polyethylene glycols, dibutylene glycol, polybutylene glycols, ethylene glycol, ethylene glycol monobutyl ether (EGMBE), diethylene glycol monoethyl ether, ethanolamine, diethanolamine (DEA), triethanolamine (TEA), and combinations thereof.

In some embodiments, the sacrificial material precursor comprises a water soluble polymer, such as 1-vinyl-2-pyrrolidone, vinylimidazole, polyethylene glycol diacrylate, acrylic acid, sodium styrenesulfonate, Hitenol BC10®, Maxemul 6106e, hydroxyethyl acrylate and [2-(methacryloyloxy)ethyltrimethylammonium chloride, 3-allyloxy-2-hydroxy-1-propanesulfonic acid sodium, sodium 4-vinylbenzenesulfonate, [2-(methacryloyloxy)ethyl]dimethyl-(3-sulfopropyl)ammonium hydroxide, 2-acrylamido-2-methyl-1-propanesulfonic acid, vinylphosphonic acid, allyltriphenylphosphonium chloride, (vinylbenzyl)trimethylammonium chloride, allyltriphenylphosphonium chloride, (vinylbenzyl)trimethylammonium chloride, E-SPERSE RS-1618, E-SPERSE RS-1596, methoxy polyethylene glycol monoacrylate, methoxy polyethylene glycol diacrylate, methoxy polyethylene glycol triacrylate, or combinations thereof.

Here, the additive manufacturing system 400 shown in FIG. 4A further includes the system controller 410 to direct the operation thereof. The system controller 410 includes a programmable central processing unit (CPU) 434 which is operable with a memory 435 (e.g., non-volatile memory) and support circuits 436. The support circuits 436 are conventionally coupled to the CPU 434 and comprise cache, clock circuits, input/output subsystems, power supplies, and the like, and combinations thereof coupled to the various components of the additive manufacturing system 400, to facilitate control thereof. The CPU 434 is one of any form of general purpose computer processor used in an industrial setting, such as a programmable logic controller (PLC), for controlling various components and sub-processors of the additive manufacturing system 400. The memory 435, coupled to the CPU 434, is non-transitory and is typically one or more of readily available memories such as random access memory (RAM), read only memory (ROM), floppy disk drive, hard disk, or any other form of digital storage, local or remote.

Typically, the memory 435 is in the form of a computer-readable storage media containing instructions (e.g., non-volatile memory), which when executed by the CPU 434, facilitates the operation of the manufacturing system 400. The instructions in the memory 435 are in the form of a program product such as a program that implements the methods of the present disclosure.

The program code may conform to any one of a number of different programming languages. In one example, the disclosure may be implemented as a program product stored on computer-readable storage media for use with a computer system. The program(s) of the program product define functions of the embodiments (including the methods described herein).

Illustrative computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the methods described herein, are embodiments of the present disclosure. In some embodiments, the methods set forth herein, or portions thereof, are performed by one or more application specific integrated circuits (ASICs), field-programmable gate arrays (FPGAs), or other types of hardware implementations. In some other embodiments, the polishing pad manufacturing methods set forth herein are performed by a combination of software routines, ASIC(s), FPGAs and, or, other types of hardware implementations.

Here, the system controller 410 directs the motion of the manufacturing support 402, the motion of the dispense heads 404 and 406, the firing of the nozzles 416 to eject droplets of pre-polymer compositions therefrom, and the degree and timing of the curing of the dispensed droplets provided by the UV radiation source 408. In some embodiments, the instructions used by the system controller to direct the operation of the manufacturing system 400 include droplet dispense patterns for each of the print layers to be formed. In some embodiments, the droplet dispense patterns are collectively stored in the memory 425 as CAD-compatible digital printing instructions. Examples of print instructions which may be used by the additive manufacturing system 400 to manufacture the polishing pads described herein are shown in FIGS. 5A-5C.

Figure 5A:
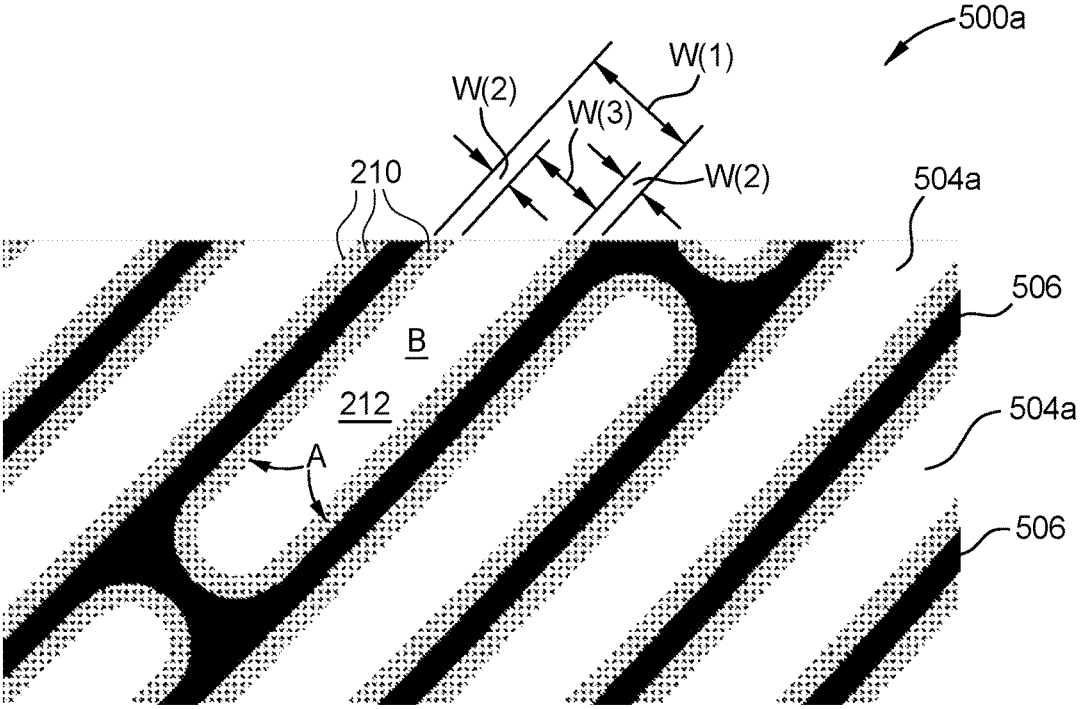
FIGS. 5A-5C show portions of CAD compatible print instructions 500*a-c*, which may be used to form the polishing pads, described herein.
Figure 5B:
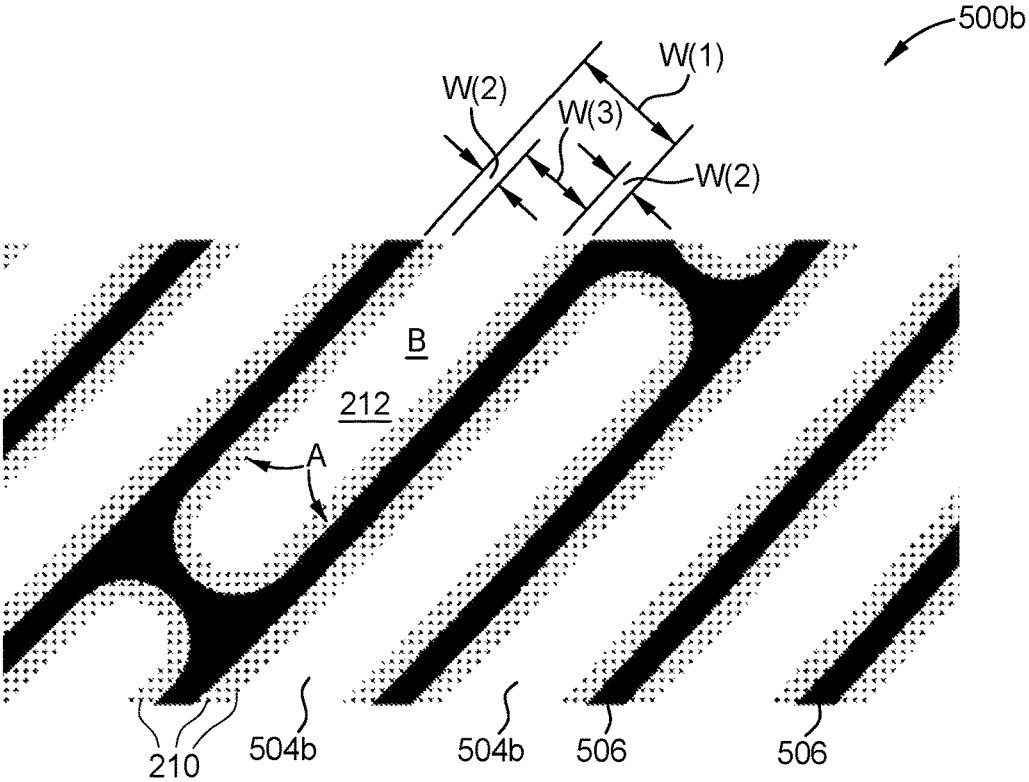
Figure 5C:
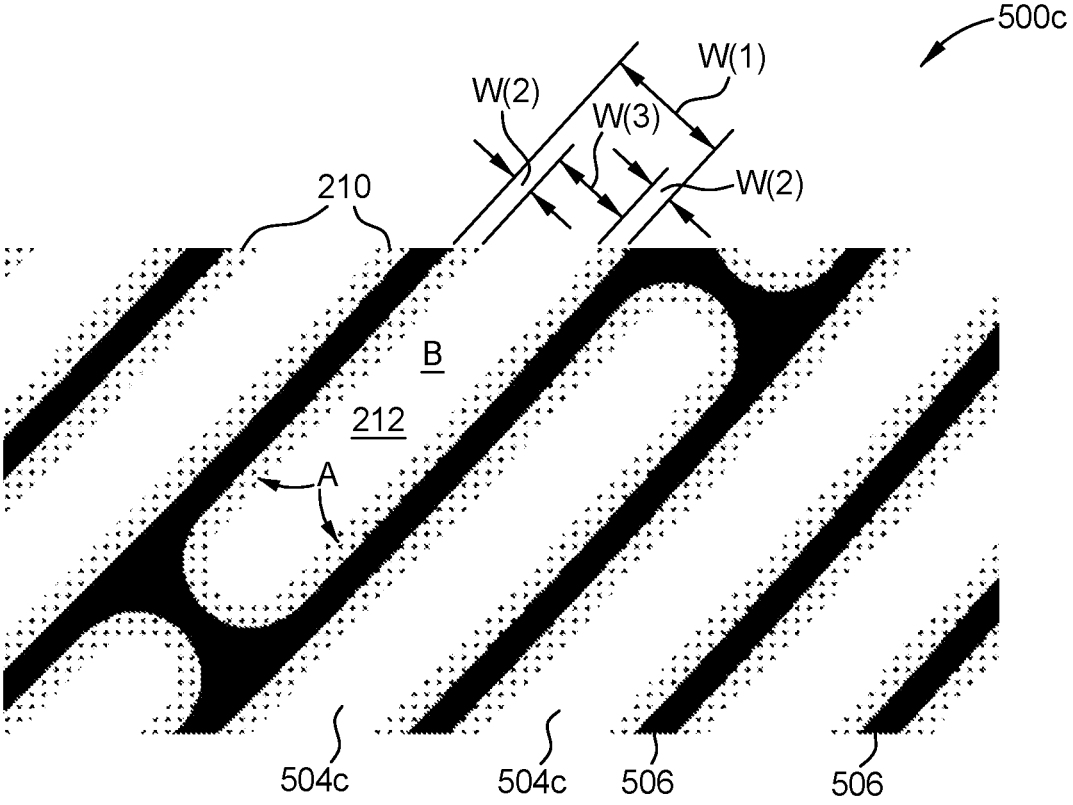

FIGS. 5A-5C show portions of CAD compatible print instructions 500*a-c* which may be used by the additive manufacturing system 400 to form embodiments of the polishing pads described herein. Here, the print instructions 500*a-c* are for print layers used to form polishing elements 504*a-c* respectively. Each of the polishing elements 504*a-c* are formed of the polymer material 212 and comprise relatively high porosity regions A disposed proximate to the sidewalls of the polishing elements 504*a-c* and relatively low porosity regions B disposed inwardly of the relatively high porosity regions A. Droplets of the pre-polymer composition(s) used to form the polymer material 212 will be dispensed in the white regions and droplets of the sacrificial material composition(s) will be dispensed within the black pixels of the high porosity regions A. In this print layer, no droplets will be dispensed in the black regions 506 between the polishing elements 504*a-c* (outside of the relatively high porosity regions A). The print instructions 500*a-c* may be used to form relatively high porosity regions A each having a porosity of 25%, 16%, and 11% respectively and relatively low porosity regions B having no intended porosity (e.g., less than about 0.1% porosity). Here, the width W(1) of each polishing element 504*a-c* is about 2.71 mm, the widths W(2) of the relatively high porosity regions A are each about 460 μm, and the width W(3) of the relatively low porosity region B is about 1.79 mm.

Polishing pads formed according to embodiments described herein show unexpectedly superior performance in dielectric CMP processing when compared to similar polishing pads having uniformly distributed porosity. A comparison of CMP performance between continuous porosity and a selective porosity pad is set forth in Table 1 below. Sample polishing pad D in table 1 was formed using the print instructions 500*a* of FIG. 5A. Sample polishing pads A-C were formed using the same material precursors and substantially the same print instructions as 500*a* except the pores of sample polishing pads A-C were uniformly distributed across the polishing elements to achieve uniform porosities of 33%, 11%, and 5% respectively. Each of the sample polishing pads A-D were used to polish a blanket film of silicon oxide film layer disposed on a patterned substrate comprising a design architecture used in manufacture of logic and memory devices. The silicon oxide film was conventionally deposited using a tetraethylorthosilicate (TEOS) precursor. Surprisingly, the sample polishing pad D having selectively arranged regions of relatively high porosity disposed adjacent to regions of relatively low porosity provided desirably higher oxide removal rates when compared to polishing pads have uniformly distributed porosity values both higher and lower than that of the A regions of sample D.

TABLE 1

| Sample Polishing Pads | Segment Length (mm) | Feature Width (mm) | Comments | Porosity (%) | Polish Layer Hardness (Shore D) | Foundation Layer | Normalized Maximum Oxide Removal Rate |
|---|---|---|---|---|---|---|---|
| A | 100 | 2.71 | Continuous | 33% | 55D | 62D | 100.0% |
| B | 100 | 2.71 | Porosity | 11% | 63D | 62D | 161.5% |
| C | 100 | 2.71 | | 5% | 71D | 62D | 138.5% |
| D | 100 | 2.71 | Porosity only on edge of the pads | 25% on Edge Only | 55D | 62D | 200.0% |

Figure 6:
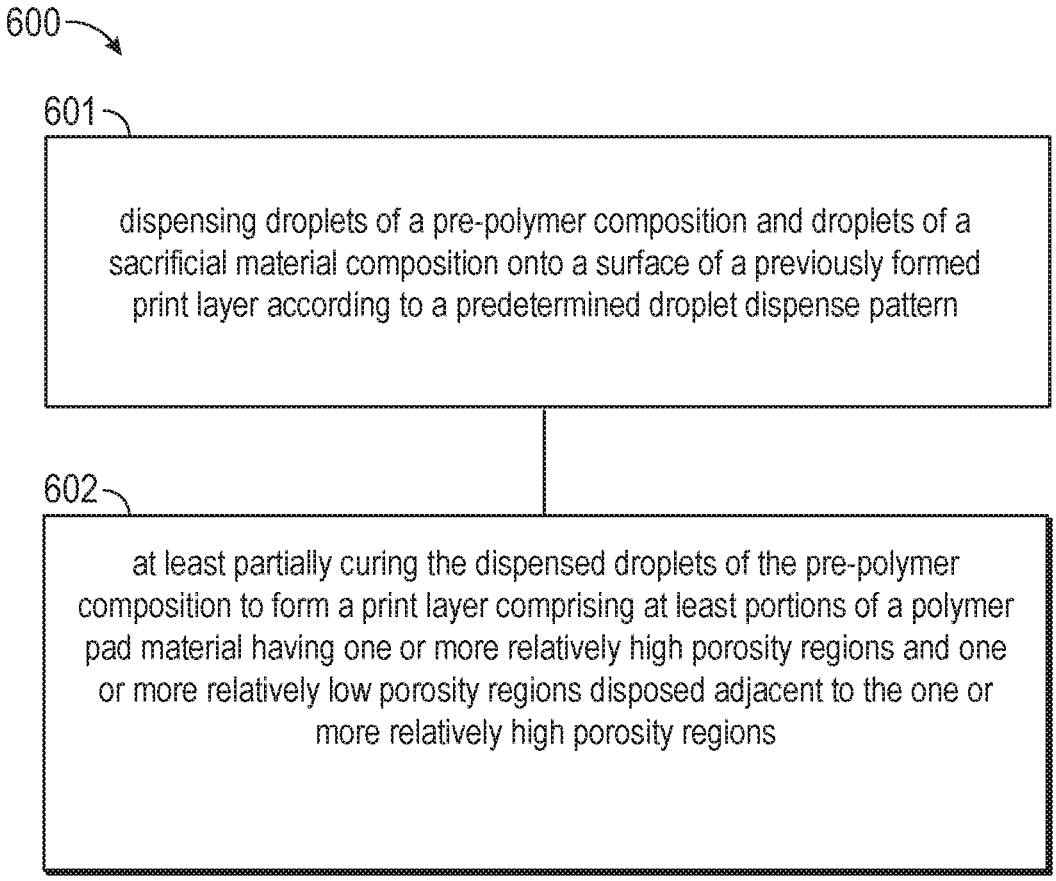
FIG. 6 is a flow diagram setting forth a method of forming a polishing pad, according to one or more, or a combination of, the embodiments described herein.

FIG. 6 is a flow diagram setting forth a method of forming a print layer of a polishing pad according to one or more embodiments. Embodiments of the method 600 may be used in combination with one or more of the systems and system operations described herein, such as the additive manufacturing system 400 of FIG. 4A, the fixed droplets of FIG. 4B, and the print instructions of FIGS. 5A-5C. Further, embodiments of the method 600 may be used to form any one or combination of embodiments of the polishing pads shown and described herein.

While FIGS. 5A-5C illustrate a configuration where a polishing feature includes a relatively high porosity regions A disposed proximate to the sidewalls of the polishing elements 504*a-c* and a relatively low porosity regions B disposed inwardly of the relatively high porosity regions A this configuration is not intended to be limiting as to the scope of the disclosure provided herein, since it may be desirable, depending on the polishing application, to alternately form the relatively high porosity regions A proximate to the inward region of the polishing elements 504*a-c* and form the relatively low porosity regions B proximate to the sidewalls of the polishing elements 504*a-c*.

At activity 601 the method 600 includes dispensing droplets of a pre-polymer composition and droplets of a sacrificial material composition onto a surface of a previously formed print layer according to a predetermined droplet dispense pattern.

At activity 602 the method 600 includes at least partially curing the dispensed droplets of the pre-polymer composition to form a print layer comprising at least portions of a polymer pad material having one or more relatively high porosity regions and one or more relatively low porosity regions disposed adjacent to the one or more relatively high porosity regions.

In some embodiments, the method 600 further includes sequential repetitions of activities 601 and 602 to form a plurality of print layers stacked in a Z-direction, i.e., a direction orthogonal to the surface of the manufacturing support or a previously formed print layer disposed thereon. The predetermined droplet dispense pattern used to form each print layer may be the same or different as a predetermined droplet dispense pattern used to form a previous print layer disposed there below.

The polishing pads and polishing pad manufacturing methods described herein beneficially allow for selectively arranged pores and resulting discrete regions of porosity that enable fine tuning of CMP process performance.

While the foregoing is directed to embodiments of the present disclosure, other and further embodiments of the disclosure may be devised without departing from the basic scope thereof, and the scope thereof is determined by the claims that follow.

The invention claimed is:

1. A polishing pad, comprising:

a plurality of polishing elements, each comprising:

an individual surface that forms a portion of a polishing surface of the polishing pad; and one or more sidewalls extending downwardly from the individual surface to define a plurality of channels disposed between the polishing elements, wherein each of the polishing elements is formed of a continuous phase of polymer material having one or more first regions comprising a first porosity and a second region comprising a second porosity, porosity is a volume of void-space or sacrificial material as a percentage of total volume in the respective first and second regions, the second porosity is less than the first porosity, the one or more first regions comprising the first porosity having selectively arranged pores; and the one or more first regions comprising the first porosity are disposed proximate to the one or more sidewalls and the second region comprising the second porosity is disposed inwardly from the one or more first regions.

2. The polishing pad of claim 1, wherein the first porosity is about 3% or more and the second porosity is less than ⅘ths of the first porosity.

3. The polishing pad of claim 2, wherein the second region comprises substantially no porosity.

4. The polishing pad of claim 3, further comprising:

a foundation layer, wherein the plurality of polishing elements are disposed on the foundation layer, the sidewalls of the individual polishing elements extend upwardly from a surface of the foundation layer, and the foundation layer is formed of a different pre-polymer composition than a pre-polymer composition used to form the continuous phase of polymer material of the polishing elements.

5. The polishing pad of claim 1, wherein the one or more first regions disposed proximate to the sidewall has a width in a range of about 50 μm to about 2 mm.

6. The polishing pad of claim 5, wherein the second region disposed inwardly from the one or more first regions has a width in a range of about 50 μm to about 5 mm.

7. The polishing pad of claim 1, wherein the selectively arranged pores of the one or more first regions are vertically disposed in one or more columnar arrangements where the selectively arranged pores in each column of the columnar arrangement are in substantial vertical alignment and spaced apart by the continuous phase of polymer material.

8. The polishing pad of claim 1, wherein the selectively arranged pores of the one or more first regions are vertically disposed in one or more staggered columnar arrangements where each pore is offset in one or both of the X-Y directions with respect to a pore that is disposed thereabove and/or therebelow.

9. The polishing pad of claim 1, wherein the plurality of polishing elements comprise a plurality of segmented concentric rings disposed about a post and extending radially outward from the post.

10. The polishing pad of claim 9, wherein the post is disposed in a center of the polishing pad.

11. The polishing pad of claim 9, wherein the post is offset from a center of the polishing pad.

12. A method of polishing a substrate, comprising:

urging a substrate against a polishing surface of a polishing pad, the polishing pad comprising a plurality of polishing elements, each comprising:

an individual surface that forms a portion of the polishing surface; and one or more sidewalls extending downwardly from the individual surface to define a plurality of channels disposed between the polishing elements, wherein each of the polishing elements is formed of a continuous phase of polymer material having one or more first regions comprising a first porosity and a second region comprising a second porosity, porosity is a volume of void-space or sacrificial material as a percentage of total volume in the respective first and second regions, and the second porosity is less than the first porosity, the one or more first regions comprising the first porosity having selectively arranged pores; and the one or more first regions comprising the first porosity are disposed proximate to the one or more sidewalls and the second region comprising the second porosity is disposed inwardly from the one or more first regions.

13. The method of claim 12, wherein the first porosity is about 3% or more and the second porosity is less than ⅘ths of the first porosity.

14. The method of claim 12, wherein the polishing pad further comprises a foundation layer, the plurality of polishing elements are disposed on the foundation layer, the sidewalls of the individual polishing elements extend upwardly from a surface of the foundation layer, and the foundation layer is formed of a different pre-polymer composition than a pre-polymer composition used to form the continuous phase of polymer material of the polishing elements.

15. A polishing pad, comprising:

a foundation layer; and a plurality of polishing elements disposed on the foundation layer, each comprising:

an individual surface that forms a portion of a polishing surface of the polishing pad; and one or more sidewalls extending downwardly from the individual surface to a surface of the foundation layer, wherein the sidewalls and the surface of the foundation layer define a plurality of channels disposed between the polishing elements, wherein each of the polishing elements is formed of a continuous phase of polymer material having one or more first regions comprising a first porosity and a second region comprising a second porosity, porosity is a volume of void-space or sacrificial material as a percentage of total volume in the respective first and second regions, the second porosity is less than the first porosity, the one or more first regions comprising the first porosity having selectively arranged pores, the one or more first regions comprising the first porosity are disposed proximate to the one or more sidewalls and the second region comprising the second porosity is disposed inwardly from the one or more first regions, the one or more first regions has a height extending from the individual surface of the polishing element to the surface of the foundation layer and a width extending from the one or more sidewalls to the second region comprising the second porosity, and the width of the one or more first regions is less than a width of the second region comprising the second porosity.

16. The polishing pad of claim 15, wherein the first porosity is about 3% or more and the second porosity is less than ⅘ths of the first porosity and the second region comprises substantially no porosity.

17. The polishing pad of claim 16, wherein the one or more first regions has a width in a range of about 50 μm to about 2 mm and the second region has a width in a range of about 50 μm to about 5 mm.

18. The polishing pad of claim 15, wherein the selectively arranged pores of the one or more first regions are vertically disposed in one or more columnar arrangements where the selectively arranged pores in each column of the columnar arrangement are in substantial vertical alignment and spaced apart by the continuous phase of polymer material.

19. The polishing pad of claim 15, wherein the selectively arranged pores of the one or more first regions are vertically disposed in one or more staggered columnar arrangements where each pore is offset in one or both of the X-Y directions with respect to a pore that is disposed thereabove and/or therebelow.

20. The polishing pad of claim 15, wherein the plurality of polishing elements comprise a plurality of segmented concentric rings disposed about a post and extending radially outward from the post.

* * * * *